United States Patent [19]

Black et al.

[11] Patent Number: 5,009,618

[45] Date of Patent: Apr. 23, 1991

[54] METHOD AND APPARATUS FOR MAKING ELECTRICAL CONNECTING DEVICE

[75] Inventors: Robert H. Black, Jacksonville, Fla.; John T. Venaleck, Madison, Ohio

[73] Assignee: Ohio Associated Enterprises, Inc., Painesville, Ohio

[21] Appl. No.: 349,754

[22] Filed: May 10, 1989

Related U.S. Application Data

[62] Division of Ser. No. 920,273, Oct. 17, 1986, Pat. No. 4,863,402.

[51] Int. Cl.[5] ..... H01R 13/405

[52] U.S. Cl. ..... 439/736; 439/856

[58] Field of Search ..... 439/722, 736, 733, 391–407, 439/856; 29/856, 858, 883

[56] References Cited

U.S. PATENT DOCUMENTS

| | | | |
|---|---|---|---|
| 2,958,842 | 11/1960 | Schaefer | 439/736 |
| 3,241,096 | 3/1966 | Miller . | |
| 3,328,504 | 6/1967 | Hamel . | |
| 3,866,319 | 2/1975 | Steigerwald . | |
| 3,874,762 | 4/1975 | Shott et al. | 439/425 |
| 4,283,100 | 8/1981 | Griffin et al. . | |
| 4,319,800 | 3/1982 | Bernat | 439/736 |
| 4,449,771 | 5/1984 | Carr . | |
| 4,460,231 | 7/1984 | Muz . | |
| 4,516,817 | 5/1985 | Deters . | |
| 4,580,869 | 4/1986 | Demurjian | 439/736 |
| 4,795,602 | 1/1989 | Pretchel | 439/510 |

FOREIGN PATENT DOCUMENTS

| | | | |
|---|---|---|---|
| 1380706 | 1/1975 | United Kingdom | 439/736 |
| 2094569 | 9/1982 | United Kingdom . | |

*Primary Examiner*—David L. Pirlot

*Attorney, Agent, or Firm*—Renner, Otto, Boisselle & Sklar

[57] ABSTRACT

Method and apparatus for making an electrical device including a contact supported in a housing having a space within which at least part of such contact may move, wherein the contact is placed with respect to a mold core that resiliently deforms the moving part of the contact to a condition it ordinarily would be expected to take during use in connection with another contact and cooperates with at least such moving part of the contact to form a composite core that is placed in a mold cavity to mold a housing about part of the contact and to at least part of the contact while the composite core defines the space within which the moving part of the contact can deform during use. An electrical connecting device is made by the aforementioned process. Also, an electrical connecting device includes an electrical contact, a housing having an opening for receiving a member for contacting the electrical contact, the electrical contact including two or more contacting portions for contacting the member placed therebetween to engagement therewith, such contacting portions being deformable during such placing, and the housing including a body molded to form a singular integral structure about and to at least part of the electrical contact and around the contacting portions to form a substantially open space in the housing between the contacting portions and also on opposite sides thereof to permit such deformation of the contacting portions.

16 Claims, 9 Drawing Sheets

METHOD AND APPARATUS FOR MAKING ELECTRICAL CONNECTING DEVICE

This is a divisional of co-pending application Ser. No. 920,273 filed on Oct. 17, 1986 U.S. Pat. No. 4,863,402.

TECHNICAL FIELD

The invention herein disclosed relates generally to methods and apparatus for making electrical devices, such as electrical connectors, cable termination assemblies, jumpers, and the like; and also to electrical devices. More particularly, the invention relates to methods, apparatus and articles of the type described which are characterized by an electrical member cooperating with a mold core to assume a condition deflected, displaced or deformed from a relaxed or another condition thereby to form a composite core for use in molding a singular integral housing structure about and to such electrical member.

BACKGROUND OF THE INVENTION

Several examples of electrical devices or connectors of the type to which the present invention relates are those sometimes referred to as cable terminations, cable termination assemblies, headers, jumpers, and edge board connectors. The foregoing are not intended to limit the devices which may incorporate principles of the invention; rather they are mentioned for convenience to facilitate the following description. Nevertheless, it will be appreciated that the features and principles of the invention may be included in other devices intended for electrical connection purposes.

A cable termination may be defined as an electrical connector intended to connect the conductor(s) of an electrical cable to one or more further electrically conductive members. An exemplary cable termination may include one or more electrically conductive members, for example, electrical contacts, and a support or housing for supporting such contacts for the intended electrical connection purpose. A cable termination assembly may be defined as a cable termination in combination with the electrical cable intended to be terminated, i.e., the conductor(s) of such cable is (are) intended to be connected to further members via the contact(s) of the cable termination of such assembly.

There are various types of electrical contacts. Conventionally, electrical contacts are categorized in at least two groups, male type, such as pin contacts, and female type, such as fork contacts. For example, a pin contact may be inserted between the tines of a fork contact to engage the same thereby to create an electrical connection of the contacts. A box contact is another example of a female contact. A leaf type contact and a bow type contact in which a portion of the respective contact tends to deform, preferably resiliently, as another member, such as a pin contact, is placed to engagement therewith, also have a similar characteristic to the fork and box contacts in that such deformation occurs during engagement with a further member in use of the contact. For convenience of the following description, reference to female contacts is intended to mean a contact that has at least one part thereof that is intended to deform, or deflect or displace, from one condition to another during use of the contact. Indeed, such deformation preferably is of the resilient type whereby the contact ordinarily is in a rest, unstressed (or preloaded with relatively low stress), or undeformed condition, mode or shape, and in response to the placing of a further member, such as a pin contact, to engagement therewith, the female contact would tend to undergo some resilient deformation to a stressed, deformed, contacting condition. Preferably, the resiliency characteristic is a function of the contact itself, although such characteristic may be achieved by other means such as a separate spring or spring-like element acting on the contact.

A header typically is an electrical connector device of a type that has contacts held with respect to a molded body; the contacts are intended to connect circuits on a printed circuit board and further conductors or circuits that are not on such printed circuit board. Often a header is attached, mounted, soldered or otherwise associated with a printed circuit board. A jumper is a device that usually is employed to interconnect at least two electrical circuits, for example, by engaging with and electrically connecting two pin contacts. Often a jumper is used to interconnect (or not, e.g., by removal of the jumper) selected circuits on a printed circuit board, say to identify certain characteristics of the printed circuit board, such as memory size, starting address, etc. An edge board connector, for example, is a connector that may be connected to printed circuit terminal pads or the like at or proximate the edge of a printed circuit board. In an exemplary case, an edge board connector may be a particular type of cable termination assembly intended to connect with such terminal pads on a printed circuit board. Another type of edge board connector is one which is mounted on one printed circuit board, and having contacts that are electrically connected to printed circuits on that printed circuit board and are electrically connectable to terminal pads of another printed circuit board to facilitate so called mother board-daughter board arrangements.

The foregoing descriptions and definitions are presented by way of example to facilitate the following detailed description of the invention. However, it is intended that such foregoing descriptions and definitions are not intended to limit the invention or the types of devices to and in which the principles and features of the invention may be applied.

In many prior electrical connector devices it generally has been the case that multiple parts have to be assembled and mechanically, adhesively, etc. held together. One example is the cable termination assembly disclosed in U.S. Pat. No. 4,030,799. A cable termination assembly as disclosed in said patent includes a multiconductor electrical cable having plural parallel conductors separated from each other in the cable insulation, plural electrical contacts respectively electrically connected to cable conductors, and a body molded about and to at least part of the conductors and contacts, including the junctions thereof, to form therewith an integral structure. The contacts are of the fork type. Further, such cable termination assembly includes a cover or cap that has a plurality of cells or chambers therein for containing the tines or arms of respective fork contacts, for guiding pin contacts to engagement with the respective tines, and for permitting resilient deformation of the tines during insertion and/or removal of respective pin contacts. Such cover is molded in a separate process and must be secured, e.g., by ultrasonic welding, to the molded body to form what may be called a composite integral body. It however would be desirable to mold the body and the cover in a single process to form a singular integral structure, and the present invention provides for this, as is described in further detail below.

Various other electrical connection devices, such as jumpers as well as cable terminations other than those of the type disclosed in said patent, require the assembling of multiple parts, including the inserting or assembling of the electrical contact(s) with respect to a housing, cover, cap, body, or other support that holds the contact(s) in position for use in performing electrical connection functions. Such covers, for example, and/or other parts of the device(s) usually are molded to provide adequate space within chambers thereof to accommodate the resilient deformation of the contact(s) during insertion and withdrawal of another member with respect thereto.

Although headers previously have been molded as integral structures formed by a molded body containing plural contacts, the contacts were pin contacts. To use female contacts in a header, edge board connector, or the like, it was necessary in the past separately to assemble plural molded parts to make the device.

BRIEF SUMMARY OF THE INVENTION

With the foregoing in mind, then, the present invention provides an electrical device and method of making characterized by a singularly molded integral body that forms a strain relief or support for one or plural female contacts, (as a cable termination assembly such body forms a strain relief for the cable/contacts junctions), and also forms a housing that contains at least part of the female contact(s) with space in the housing permitting the contact(s) to move during the relative placement of a further member, such as a pin contact, with respect thereto.

According to one aspect of the invention, a method of making an electrical device including an electrically conductive member supported in a molded body of electrically non-conductive material, the molded body having therein a space in which at least part of the conductive member is movable for electrically connecting with an external member inserted into said space, comprises the steps of placing the conductive member in a mold, molding the body using the mold, and removing the molded body from the mold with the conductive member supported therein, said placing step including placing the conductive member into engagement with a mold core such that the movable part of the conductive member cooperates with the mold core to form a composite mold core defining the space in the body, and said molding step including molding the body to and about the composite mold core with at least a part of the body being molded into engagement with the movable part of the conductive member to form a wall of the space in the body. During placing of the conductive member the conductive member is resiliently deformed at a resiliently deformable portion thereof to deflect the movable part of the conductive member to a condition different than its normal undeformed condition. The mold core and movable part of the conductive member cooperate to define a chamber of adequate size to permit movement of the movable part by resilient return of the deformable portion to a less deformed condition.

According to another aspect of the invention, an electrical connecting device comprises an electrical contact, housing means for containing at least part of said contact, said housing means having opening means for receiving therein at least one member for contacting said contact, said contact including at least two contacting means for contacting at least one member relatively placed to engagement therewith, at least one of the contacting means being capable of deformation during such relative placing, said housing means including a body molded to form an integral structure about and to at least part of said contact and around at least part of said two contacting means to form an open space in said housing means between and on opposite sides of said two contacting means to permit such deformation of said contacting means, and said opening means providing a path for insertion of the one member into said space.

The foregoing and other features of the invention hereinafter are fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
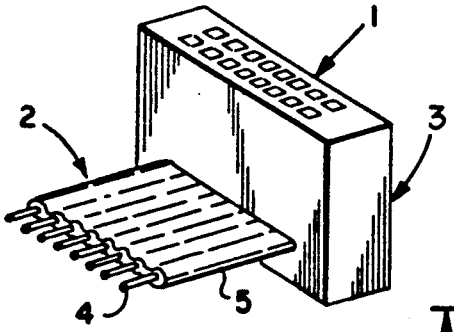
FIG. 1 is a perspective view of a cable termination assembly according to the present invention.

Referring now in detail to the drawings and initially to FIG. 1, a cable termination assembly made in accordance with the present invention is schematically illustrated at 1. The cable termination assembly 1 includes an electrical cable 2 and a cable termination 3. The cable 2 includes one or more electrical conductors 4 within cable insulation 5 and, with additional reference to FIGS. 2-5, the cable termination 3 includes one or more electrical contacts 6 electrically connected to respective cable conductors 4 and held in relative position by a strain relief body or housing 7. The strain relief body 7 preferably is molded directly to and about at least a part of the cable 2 and contacts 6 to form therewith a unified structure.

The strain relief body 7 has a base portion 10 and a cover portion 11 which, in the case of the illustrated cable termination assembly, generally correspond to the base and cover of cable termination assemblies of known type such as that disclosed in U.S. Pat. No. 4,030,799. Accordingly, the base portion 10 provides strain relief while the cover portion 11 contains and protects female contacting portions 12 of the contacts 6, maintains electrical isolation of such contacting portions, and guides mating male contacts such as pin contacts or the like to proper engagement with the contacting portions. In such known cable termination assembly, the cover is separately molded and joined as by ultrasonic welding to the base whereas, in contrast, the present invention provides for simultaneous molding of the base portion 10 and cover portion 11 in a single process to form a singular integral structure. As used herein, the term "singular integral structure" is used to differentiate the above simultaneously molded structure from "composite integral structures" formed by unifying two or more parts.

In the illustrated embodiment, the cable 2 is a conventional flat ribbon multi-conductor cable wherein the insulation 5 maintains the conductors 4 in parallel spaced-apart, electrically isolated relationship on, for example, 0.050 inch centers. For use with such type of cable, each contact preferably includes, in addition to the contacting portion 12, a terminal portion 13 adapted to form an insulation displacement connection (IDC) junction 14 with a respective conductor 4 of the cable 2. The contacts are of planar type and may be formed by die cutting or stamping from a thin sheet of metal material.

Figure 3:
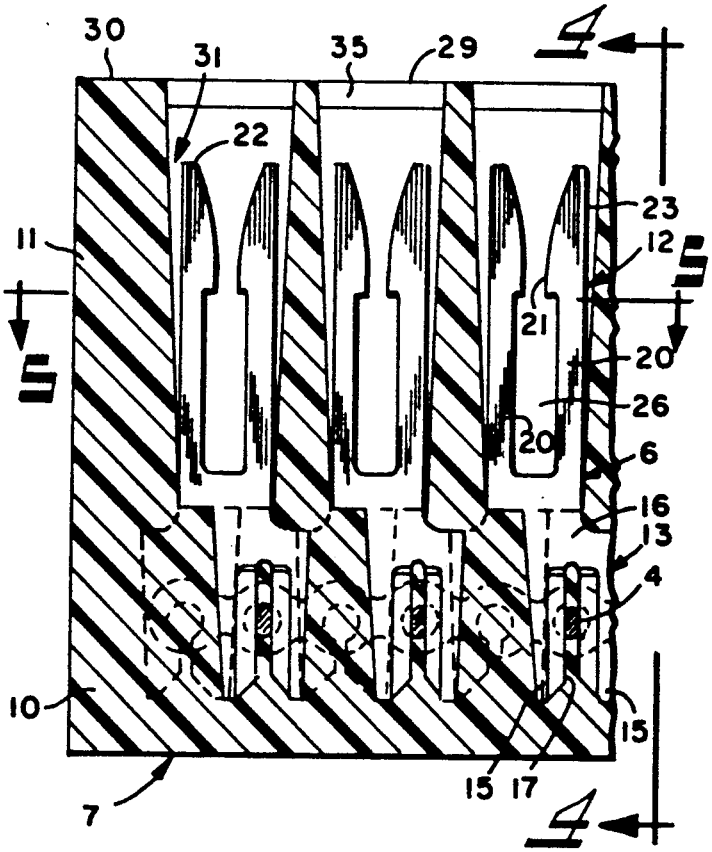
FIG. 3 is a partial sectional view of the cable termination assembly taken substantially along the line 3—3 of FIG. 2.

As best seen in FIG. 3, the terminal portion 13 of each electrical contact 6 preferably includes a pair of elongate, generally parallel, pronglike arms 15 commonly supported from a base portion 16 and defining therebetween a relatively narrow slot 17. The ends of the arms 15 remote from the base portion 16 preferably are tapered or chamfered to define an entranceway into the narrow slot 17 and to form generally pointed tips. The pointed tips facilitate penetration of the arms 15 through the cable insulation 5 for electrical connection of the contact to a conductor 4, the latter passing into the narrow slot 17 and being engaged between the arms 15. The narrow slot preferably is narrower than the normal diameter of the conductor so that some flattening of the conductor occurs to provide a relatively enlarged surface area of engagement or connection between the conductor and the arms 15.

Figure 5:
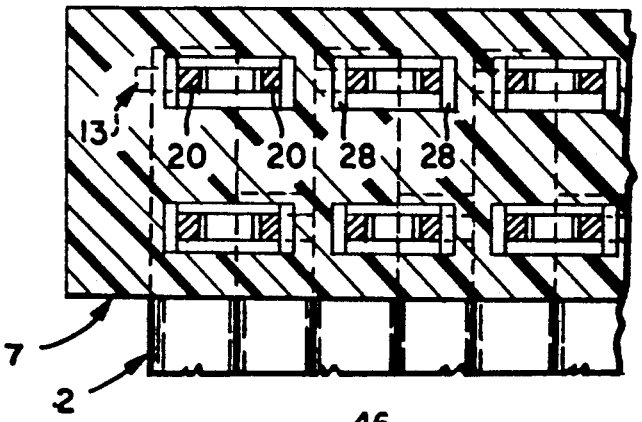
FIG. 5 is a partial sectional view of the cable termination assembly of FIG. 1 taken substantially along the line 5—5 of FIG. 3.

Like many known cable termination assemblies, the contacts 6 of the illustrated cable termination 3 are arranged in a dual-in-line pattern. As is desirable, the terminal portions 13 of the contacts 6 in one row are offset with respect to the female contacting portions 12 thereof in a direction opposite the offset of the terminal portions of contacts in the other row, as best seen in FIGS. 3 and 5. This offset configuration of the electrical contacts allows them to be of reasonable size and strength with the contacting portion 12 of each contact in one row being directly aligned with the contacting portion of an opposite contact in the other row and with each of the relatively closely positioned parallel cable conductors 4 being connected to only a single respective contact. It will be appreciated that although the illustrated embodiment utilizes two rows of contacts, principles of the invention may be, of course, employed in terminations having one or more contacts arranged in one or more rows or in other patterns as well. It also will be appreciated that the offset provides a mechanical lock against axial movement of the contacts with respect to the strain relief body 7.

Figure 2:
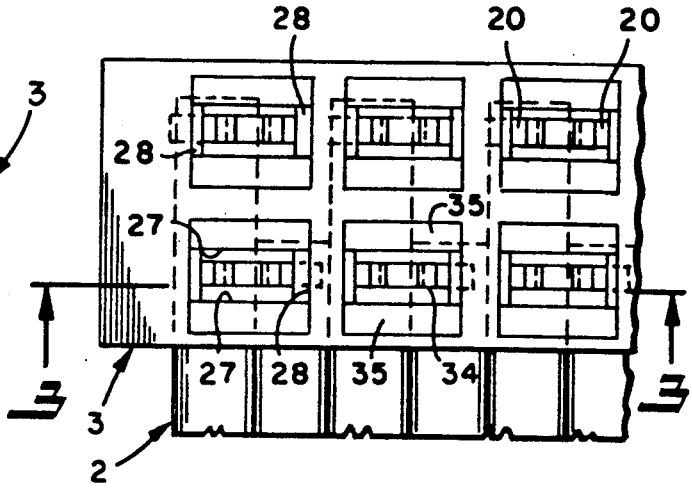
FIG. 2 is a partial top plan view of the cable termination assembly of FIG. 1.
Figure 4:
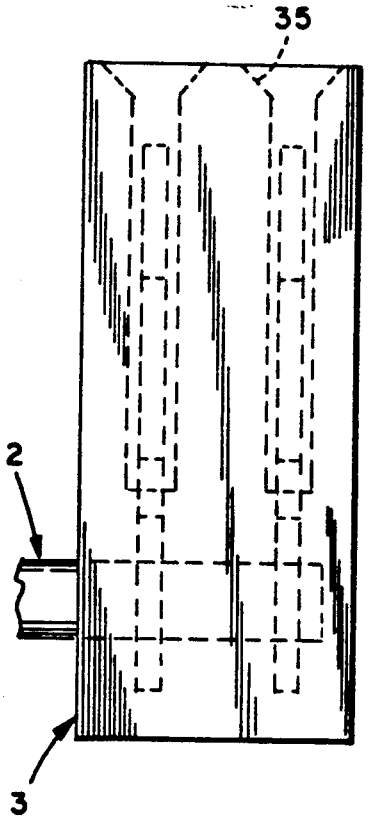
FIG. 4 is an end elevational view of the cable termination assembly of FIG. 1 looking in the direction of the arrows 4—4 of FIG. 3.

As best seen in FIGS. 2 and 3, the female contacting portion 12 of each contact 6 is of planar fork type. In general, however, the contacting portion of each contact includes at least one element, part or portion thereof which is deflectable or displaceable, preferably by resilient deformation, from one condition to another condition by another or male type member, such as a pin contact, placed to engagement therewith during use of the contact. In the case of the illustrated fork type contact, the contacting portion 12 includes a pair of resiliently deformable, generally parallel elongate tines or arms 20 extending from the base portion 16 and adapted for electrical and mechanical connection at inwardly facing edge surfaces 21 with a male contact, such as a pin contact, inserted therebetween. As seen in FIG. 3, the leading ends of the tines are rounded at 22 to facilitate guiding of a pin contact therebetween and, in general, the tines 20 may be of conventional configuration having the inwardly facing edge surfaces 21 stepped and curved as shown and generally straight outer or back edge surfaces 23 which may be substantially parallel in the undeformed or unflexed condition of the tines.

Although the illustrated contacts 6 are of planar fork type, the contacts may be of other female type having one or more deflectable portions intended to deflect when engaged by a pin contact or other external member placed to electrical and mechanical connection therewith. Such deflectable portions preferably are resiliently deformable and, more particularly, capable of bending resiliently in response to engagement with a pin contact or the like. This will become more evident from the following description wherein several other types of deflectable/female contacts are described and illustrated in the accompanying drawings.

As seen in FIGS. 2, 3 and 5, the contacting portion 12, i.e., the tines 20, of each electrical contact 6 are contained in a respective chamber or cell 26 formed in the strain relief body 7 and, more particularly, in the cover portion 11 of such body. Each cell 26 has opposed side walls 27 and opposed end walls 28. The end walls 28 are so disposed with respect to respective outer edge surfaces 23 of the contact tines to allow the tines to deform or flex resiliently away from one another upon insertion of a pin contact therebetween. As particularly shown in FIG. 3, the end walls 28 of each cell may slope slightly outwardly away from each other going from the base of the contact tines to their leading ends and further to the opening 29 at the leading end face 30 of the strain relief body, while the outer edge surfaces 23 of the contact tines may be generally parallel when in their normal or unflexed condition as above indicated. As a result, a space 31 between the outer edge surface 23 of each contact tine and respective end wall 28 of the cell progressively increases going from the base of the contact tine to the leading end of the contact tine. Accordingly, each contact tine is free to deflect in cantilever-like manner upon insertion of a pin contact between the two contact tines of the contact.

The illustrated cable termination 3 is particularly intended for use with mating round or square pin contacts, and the assembly may be adapted for any given diameter or side width dimension of the round or square pin contacts. Preferably, the contact tines 29 and cells 26 of the cable termination and the mating pin contacts or other external conductive elements intended for use therewith are relatively configured such that upon insertion of the pin contacts between the contact tines, the contact tines are flexed outwardly away from one another to a condition having the outer edge surfaces 23 thereof just or about contiguous with respective end walls 28 of the cells. This permits the contact tines to exert the maximum normal force against the sides of the pin contact while avoiding any substantial increase in insertion force that may result from the contact tines being forcibly urged by the pin contacts into engagement with the end walls of the cell. It will be appreciated, however, that the contact tines, cells and mating pin contacts may be relatively sized to obtain such forced engagement for increased normal force engagement of the contact tines with the pin contacts at the cost of an increase in insertion force. It also will be appreciated that the contact tines, cells and pin contacts may be relatively configured to leave a gap between the contact tines and the end walls of the cells after the contact arms have been flexed outwardly upon insertion of the pin or other male contact therebetween.

The contact tines 20 of each contact 6 preferably are centrally disposed with respect to the respective cell 26 with side surfaces 34 thereof spaced from the adjacent side walls 27 of the cell. In the illustrated embodiment, the side walls 27 are substantially parallel and preferably are spaced by an amount corresponding to but slightly greater than the corresponding dimension of the male contact intended to be inserted therebetween and into engagement with the contact. Accordingly, the side walls coact with corresponding sides of the male contact to maintain the male contact in the plane of the contact tines 20. To facilitate insertion of the male contact into the cell and between the side walls, the side walls at the corresponding opening 29 in the leading end or surface 30 of the strain relief body 7 terminate at tapered or beveled guide surfaces 35 which define an entranceway into the cell.

With reference to FIGS. 6–12, a preferred method of making the above described cable termination assembly in accordance with the present invention will now be described, it being understood that such method may be modified or adapted as needed to make cable termination assemblies other than above described as well as other types of electrical connectors or devices according to principles of the present invention. Initially looking at FIG. 12, a mold 40 for carrying out the method can be seen to include a lower mold part 41, an upper mold part 42 and a core member 43 which together define a mold cavity 44. The core member 43 may be included within and movable with the upper mold part 42 during opening and closing of the mold 40. The core member includes one or more mold cores 45 and, in the illustrated embodiment, the core member is in the form of a core bar including a bar-like base 46 and a plurality of mold cores 45 projecting from the base 46 as additionally seen in FIGS. 6, 8 and 10. Generally there is one mold core for each contact 6 and cell 26 associated therewith that respectively are to be molded into and formed in the strain relief body 7 of the cable termination assembly 1. Of course, the relative positions or arrangement of the mold cores also correspond to the intended arrangement of cells in the strain relief body to be molded. As will normally be the case, the mold cores are generally parallel and essentially identical to one another.

Figure 9:
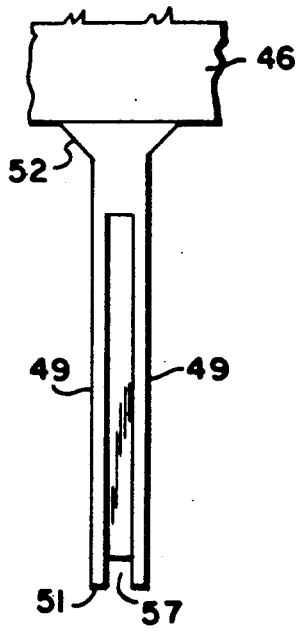
FIG. 9 is an end elevational view of the core member looking generally in the direction of the arrows 9—9 of FIG. 8.
Figure 10:
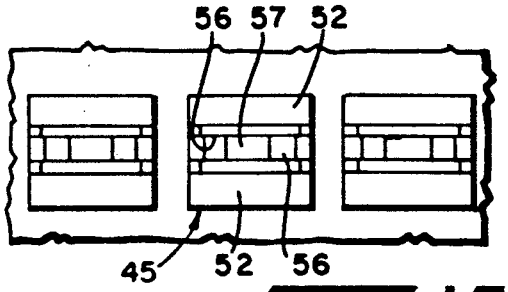
FIG. 10 is a partial bottom plan view of the core member looking generally in the direction of the arrows 10—10 of FIG. 8.
Figure 11:
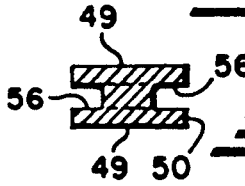
FIG. 11 is a sectional view of one core element of the molding core taken substantially along the line 11—11 of FIG. 8.

As best seen in FIGS. 9–11, each mold core 45 is generally elongate and is joined at its upper end to the base 46. The mold core has opposite side surfaces 49, opposite edge surfaces 50 and a bottom end surface 51. The side surfaces 49 preferably are parallel and terminate at their upper ends at outwardly sloped chamfer forming surfaces 52. The edge surfaces 50 extend from the planar bottom surface 53 of the base 46 and are slightly sloped towards one another going from top to bottom. Although the terms "side", "edge" and "bottom" are used to designate certain surfaces of the mold core, it should be understood that such terms are not intended to be limiting in the sense that an edge is usually narrower than a side, but instead such terms are used principally to distinguish between the surfaces for description purposes while having application to the illustrated device.

The edge surfaces 50 and bottom surface 51 are provided with respective grooves 56 and 57. The grooves 56 in the edge surfaces extend upwardly from the bottom groove 57 and give the core an H-shape in cross-section over a major extent of the length of the core as seen in FIG. 11. Accordingly, the mold core illustrated in FIGS. 8–11 may be referred to as an H-core by reason of such characteristic cross-sectional shape which is particularly adapted for use with contacts having contacting portions of forked type or other type having opposed relatively movable contacting elements intended to mate with a male contact inserted therebetween.

Figure 6:
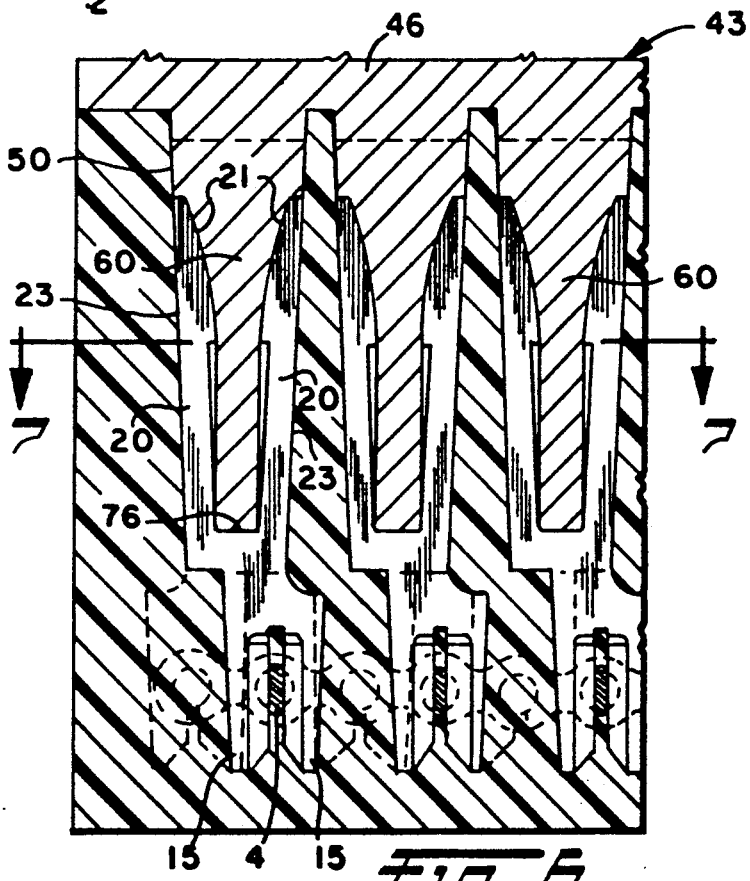
FIG. 6 is a partial sectional view similar to FIG. 3 with the cable termination assembly being shown before removal from a core member according to the present invention.
Figure 7:
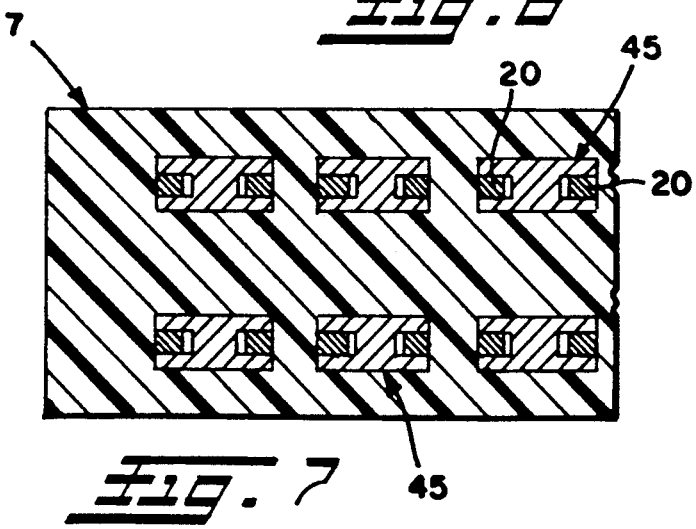
FIG. 7 is a partial sectional view taken substantially along the line 7—7 of FIG. 6.
Figure 8:
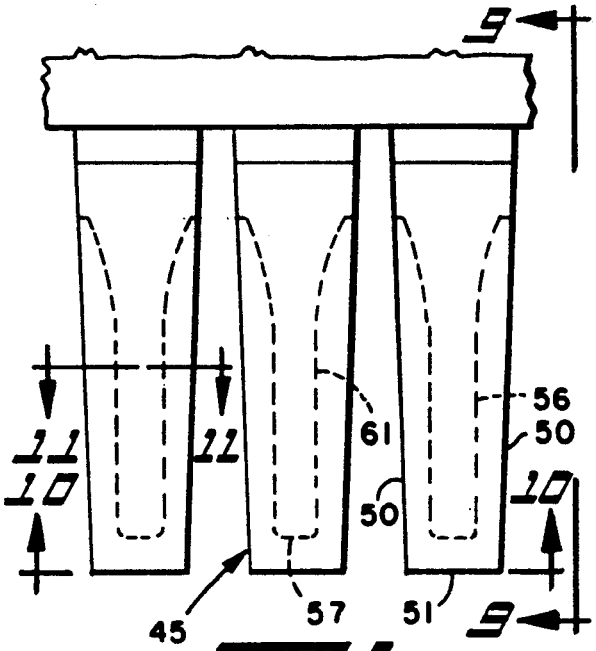
FIG. 8 is a partial front elevational view of the core member of FIG. 6.

The function of each core 45 during molding of the cable termination assembly 1 can best be described with reference to FIGS. 6 and 7 which show the cable termination assembly after molding but prior to separation from the core member 43. Prior to molding of the strain relief body 7, the contacts 6 are placed into engagement with respective cores 45 to the positions seen in FIGS. 6 and 7. More particularly, the contact tines 20 of each contact are inserted axially into the grooves 56 of the respective core with the base portion 16 being received in part in the bottom groove 57. During such insertion, the web 60 of the H-core passes between and engages the tines 20 outwardly to flex such tines. That is, the web 60 of the H-core and, more particularly, the surfaces 61 thereof forming the bottom wall of the grooves 56, are configured to cause the tines to flex outwardly and preferably to a condition with their outer or back edge surfaces 23 flush with the edge surfaces 50 of the core. Such position preferably corresponds to the normal condition of the contact tines during use in connection with a correspondingly sized male contact inserted therebetween.

At their upper ends, the grooves 56 and contact tines 20 are correspondingly configured for close sealing engagement to prevent passage of molding material therebetween during molding of the strain relief body 7 in the mold 40. Also, the side walls of the grooves 56 and 57 closely engage adjacent sides 34 of the respective contact tines and base portion 16, at least inwardly adjacent the edge and bottom end surfaces 50 and 51, to seal against passage of molding material therebetween. In this manner, the mold core cooperates with the contact tines and base portion of the contacts to form what is herein referred to as a composite mold core in part formed by the mold core and in part by a part of the contact including the deformable tines. As will be appreciated, particularly when comparing FIG. 6 to FIG. 2, the composite core defines the space within which the contact tines can deflect, i.e., resiliently deform, as when a male contact is inserted therebetween.

Figure 12:
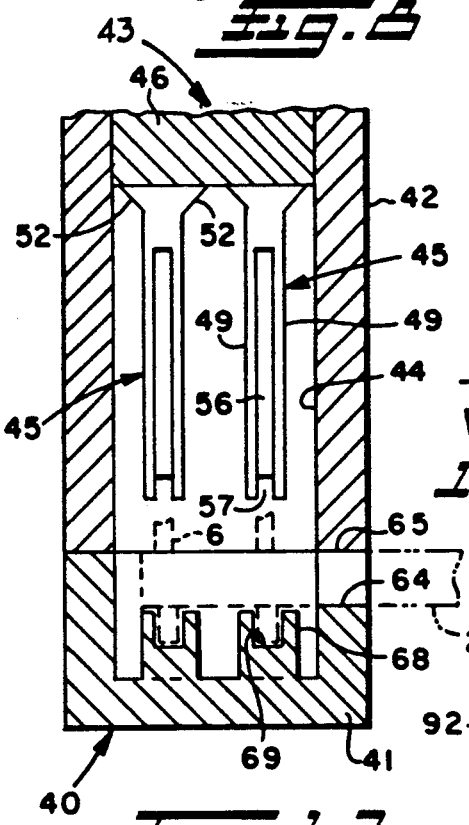
FIG. 12 is a partial sectional view showing the core member closed in relation to other mold parts of molding apparatus according to the invention.

Further with regard to the overall molding process according to the invention, the contacts 6 are placed into engagement with respective mold cores 45 as above described. It will be appreciated that the contacts may be die cut or stamped from a sheet of conductive metal with a carrier strip, in conventional manner, serving to maintain the contacts properly oriented and spaced apart for subsequent simultaneous insertion into the mold cores after which the carrier strip is removed. It also will be appreciated that the restoring force exerted by the resiliently deformed contact tines 20 and the close fit between the contact tines and the side walls of the mold core recesses 56 and 57 will serve to hold the contacts in place on the mold cores and in proper position during closing of the mold 40. As a further step preparatory to molding, the cable 2 is set in the lower mold part 41 which, as seen in FIG. 12, has a recess 64 in the parting face 65 thereof which provides for passage of the cable out of the mold. The recess 64 preferably is dimensioned so that when the mold is closed, a seal is formed by the mating mold parts around the cable.

The lower mold part 41 also includes plural anvil-like elements 68 projecting upwardly from the bottom wall of the mold cavity 44 for engaging the bottom surface of the cable 2 within the cavity. The anvil-like elements 68 serve to support the cable during IDC joinder of the terminal portions 13 of the contacts 6 with the conductors 4 of the cable. A pair of anvil-like elements preferably are provided for each contact and such elements preferably are spaced to define therebetween a slot 69 for receiving the lower end of the terminal portion of the contact which projects beneath the plane of the cable after having been forced to pierce through the cable upon closure of the mold. The anvil-like elements may be spaced to closely engage the sides of the terminal portion, i.e., the arms thereof, to form a seal therewith so that after molding of the strain relief body, the recesses formed by such elements permit access to the contacts such as for purposes of test probing. Alternatively, the anvil-like elements may be spaced apart from the terminal portion so that the terminal portion and respective IDC junction 14 between the contact and cable conductor will be fully encapsulated by the material of the molded strain relief body 7.

With the cable 2 properly positioned in the lower mold part 41 and the contacts 6 properly inserted in the mold core member 43, the mold parts then are moved towards one another by suitable means to close the mold. As the mold parts are moved thusly, the terminal arms 15 of the contacts will be caused simultaneously to pierce through the cable insulation 5 for receipt therebetween of respective cable conductors 4. During such piercing, the cable will be firmly supported at locations proximate the IDC junctions 14. Also, the contacts during IDC will be firmly supported against reactionary forces by the mold cores. As best seen in FIG. 6, the bottom surface of the web 60 of each core engages at 76 the top surface of the base portion of the contact extending between the tines 20 to provide positive axial support for the contacts.

Although the electrical junctions 14 between the contacts 6 and cable conductors 4 preferably are formed simultaneously with closing of the mold 40, it will be appreciated that the junctions may be otherwise formed. For example, the junctions may be formed outside the mold in a jig and then the thusly formed cable-contact subassembly placed in the mold. It also is noted that the cable may have insulation removed as by laser burning from portions thereof to provide for through the cable joining of the body sections above and below the cable.

After the mold 40 is closed, molten plastic material then is introduced into the mold cavity 44 as by injection to form the strain relief body 7. Preferably the molten plastic material flows around the exposed portion of the electrical junctions between the contacts and cable conductors fully to encapsulate the same. Of course, the body also will be molded about at least a portion of each of the cable and contacts, and preferably through the cable at the portions thereof from which insulation has been removed. Also, during such molding, the cells 26 in the body 7 will be formed by the composite core molds which are formed in part by the mold cores and in part by the contacting portions 12 of the contacts 6.

After such molding and opening of the mold 40, the thusly formed cable termination assembly 1 is removed from the mold. As the assembly 1 is withdrawn from the mold core, the contact tines 20 will flex back to their normal unflexed condition. As this occurs, there will be provided behind each tine an open space into which the tines may deform when a male contact is placed into engagement therewith. Since the back side 23 of each tine is held by the mold core flush with the corresponding surface 50 of the mold core, the contact tines having nothing to stick to the plastic of the body. That is, the plastic body will not be molded to the side surfaces of the tines which might interfere with free flexing of the tines within the chamber 26.

Figure 13:
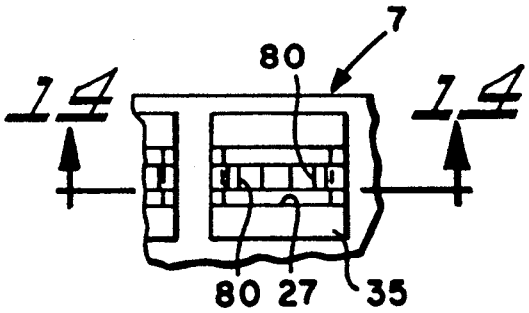
FIG. 13 is a partial top plan view corresponding to a part of FIG. 2 and showing the cable termination assembly as modified to include an optional side lead-in configuration at the entry end of each contact cell.
Figure 14:
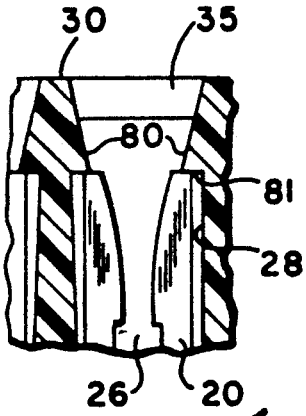
FIG. 14 is a partial sectional view of the modified cable termination assembly taken substantially along the line 14—14 of FIG. 13.

Turning now to FIGS. 13 and 14, the entry end of each cell 26 of the cable termination 3 may have an optional side lead-in configuration provided by the addition of opposed guide ramps 80. The guide ramps 80 are located on respective end walls 28 of the cell centrally between the side walls 27 and slope towards each other going from the leading end face 30 of the strain relief body 7 to the distal ends or tips of the contact tines 20. The guide ramps 80 cooperate with each other and the opposed sloping guide surfaces 35 to form a tapered entranceway for the cell 26 for guiding a pin contact or the like into the cell and between the tines of the contact. The ramps preferably overlap the leading ends of the contact tines to protect against undesirable passage of the pin contact behind either contact tine.

Figure 16:
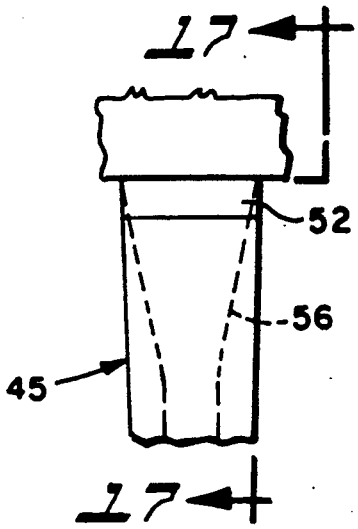
FIG. 16 is a partial elevational view of the modified mold core of FIG. 15.
Figure 17:
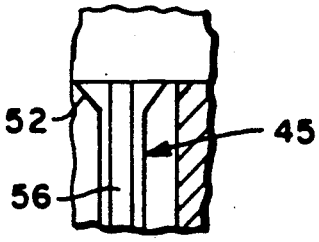
FIG. 17 is a partial elevational view of the modified mold core looking generally in the direction of the arrows 17—17 of FIG. 16.
Figure 15:
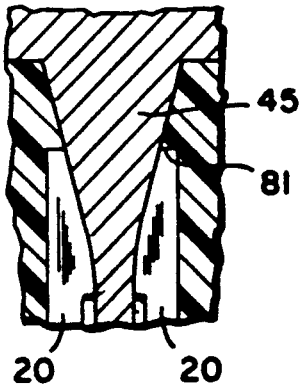
FIG. 15 is a partial sectional view similar to FIG. 14 with the modified assembly shown in relation to a mold core as modified to provide the optional side lead-in configuration.

As is preferred, the guide ramps 80 are molded as integral portions of the strain relief body 7. This is accomplished by extending the edge grooves 56 in each mold core 45 beyond the tips of the contact tines 20 as seen in FIGS. 15–17. This extension of each edge groove forms a space into which the molten plastic material will flow during molding of the strain relief body to form the respective guide ramp. As seen in FIG. 15, the tip of each contact tine, which preferably is squared off or blunted as shown, defines the bottom or shelf surface 81 of the respective ramp which is suitably oriented to allow the contact tine to return to its normal unflexed state when the mold core 45 is withdrawn from between the contact tines.

Figure 19:
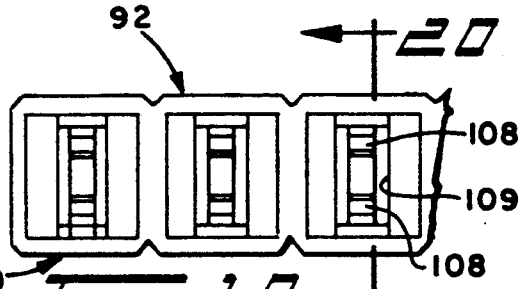
FIG. 19 is a partial top plan view of the female header looking generally in the direction of the arrows 19—19 of FIG. 18.
Figure 18:
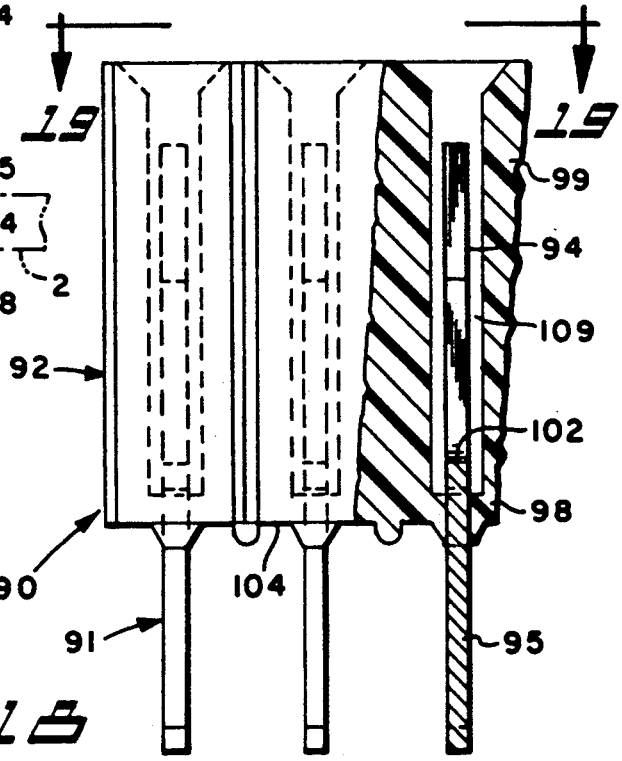
FIG. 18 is a partial view, part in elevation and part in section, of a female type header made according to the invention.
Figure 20:
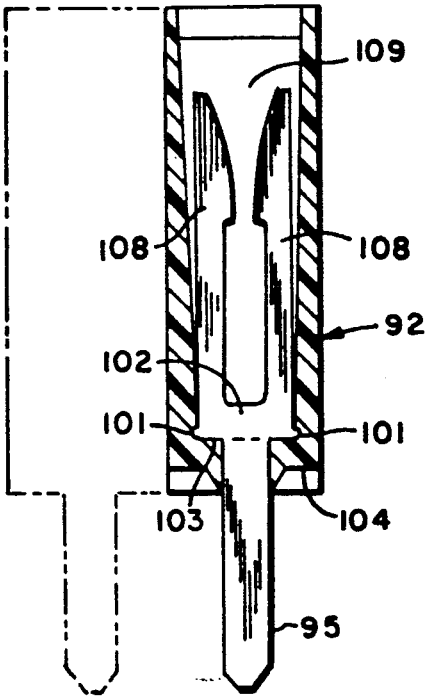
FIG. 20 is a sectional view of the female header taken substantially along the line 20—20 of FIG. 19.

In FIGS. 18–20, another embodiment of electrical connector according to the invention is indicated generally at 90 and can be seen to be in the form of a female type header. The female header 90 includes one or more electrical contacts 91 held in relative position by a molded body or housing 92. The header body 92 preferably is molded directly to and about at least a part of each contact 91 to form with the contact(s) a unified structure. The illustrated female header 90 includes one row of contacts; however, it should be understood that the present invention may be employed with headers or the like having one or more contacts arranged in one or more rows or in other patterns as well. For example, a header may have a second row of contacts, such second contact row and related body structure being outlined in phantom lines in FIG. 20. With further reference to FIG. 20, the phantom lines may be viewed as outlining a second, separately formed header which is side stackable with the solid line header with the center-to-center spacing of transversely aligned contacts of the two headers being equal the center-to-center spacing of the contacts in each header. The header 90 may also be end stackable with other headers while maintaining uniform center-to-center spacing of the contacts within and among the stacked headers.

The contacts 91 are of planar flat type and may be formed by die cutting or stamping from a thin sheet of metal conductive material preferably in the manner hereinafter described. Each contact has a female contacting portion 94 and a male contacting portion 95 extending in opposite directions. In the illustrated embodiment, the female contacting portion 94 is in the form of a planar fork contact and the male contacting portion 95 is in the form of a planar pin contact.

The header body 92 has a lower or base portion 98 which is molded directly to and about a middle portion of each contacts 91 generally coinciding with the root end of the male contacting portion 95 and which holds the contacts in relative position. The header body 92 also has an upper or cover portion 99 which functions to contain and protect the female contacting portions 94, maintain electrical isolation of the female contacting portions and guide mating male contacts such as pin contacts of an external device to proper engagement with the female contacting portions. As seen in FIG. 20, each contact 91 has a retention feature in the form of a pair of laterally extending protrusions 101 at opposite edges of base 102 of the female contacting portion 94 which provide mechanical axial interference with the header body molded thereabout to prevent axial pull-out of the contact in an upward direction in FIGS. 18 and 20. As for axial pull-out in the opposite or downward direction, this is precluded by axial interference of the shoulders 103 at the bottom of the base 102 which is wider than the root end of the male contacting portion.

The male contacting portions 95 of the contacts 91 extend through the base portion of the header body and from the bottom surface 104 of the header body 92 in generally parallel relation with respect to one another. In the illustrated embodiment, the male contacting portions are adapted for mounting of the female header 90 to a printed circuit board as by passage of the male contacting portions through plated-through holes in the printed circuit board followed by soldering of the male contacting portions to effect mechanical attachment to the printed circuit board and electrical connection to respective conductive paths on the printed circuit board. Alternatively or additionally, the male contacting portions may be adapted for inserted engagement with female type contacts of an external member such as another type of electrical connector. As seen in FIG. 20, the distal end of each male contacting portion may be tapered by chamfers 105 to facilitate assembly to or mating with an external device such as a printed circuit board or other electrical connector.

In the female header 90, the female contacting portion 94 is essentially identical to the female contacting portion 12 described above in connection with the cable termination assembly 1 of FIG. 1. Accordingly, the female contacting portion includes a pair of resiliently deformable, generally parallel elongate tines 108. The tines 108 of each contact are contained in a respective chamber or cell 109 formed in the cover portion 99 of the header body 92. In the illustrated female header 90, the relationship between the tines 108 and the walls of the cell 109, and the various details thereof, are identical to the above described corresponding structure in the cable termination assembly 1. Notwithstanding this identity, it is noted that the orientation of contacts relative to one another and the overall connector structure may differ.

As seen in FIGS. 18-20, the planes of the planar contacts 91 may be oriented at right angles to the direction of the row thereof. More particularly, the tines 108 of each contact may be opposed in a direction perpendicular to the direction in which the contacts are laterally spaced apart at a desired center-to-center spacing along the row thereof in the header 90. The tines will engage similarly oriented opposite sides of male contacts of an external device to be coupled with the female header as may be desirable, for example, where the male contacts are stamped planar pin contacts arranged in a row in the external device in coplanar relationship. As is known, contacts stamped from a sheet of metal material may result in the cut edge surfaces being rough in which case it is more desirable for the tines of fork contacts to engage the sides of the planar pin contact that are formed by the smooth surfaces of the sheet metal from which the contacts are struck.

With reference to FIGS. 21-25, a preferred method of making the above described female header 90 in accordance with the present invention will now be described. Initially looking at FIGS. 23 and 24, a contact strip suitable for use with the method is indicated generally at 114. The contact strip 114 includes plural contacts 91 attached by a pair of thin connections 115 to a carrier strip 116 for convenience of manipulation of the contacts during manufacture of electrical connection devices such as, in particular, the female header 90. The carrier strip 116 has a band-like portion 117 and plural arm portions 118 to which respective contacts 91 are connected by respective pairs of the thin connections 115 at the bifurcated ends of the arm portions 118. As shown, each arm has intermediate its length a twist 119 such that the plane of the contact is perpendicular to the plane of the band portion 117 of the carrier strip. As will be appreciated, the contacts are held properly oriented and spaced apart for subsequent engagement with mold cores of a mold for the female header 90.

Although not specifically illustrated, it should be understood that the contact strip 114 may be formed from a thin sheet of electrically conductive metal material such as nickel silver. Initially the contact strip may be cut as by die cutting or stamping from the thin sheet of conductive metal material with the contacts disposed in the plane of the sheet. The cut strip then may be subjected to a secondary forming operation during which the twists 119 are formed in the arms 118 thereby to rotate the contacts 90° out of the plane of the carrier strip 116. Such twisting may be effected in a manner generally similar to the twisting technique described in Proud U.S. Pat. No. 4,546,542. It is noted, however, that cooperating die elements of a punch may operate directly upon the contacts 91 and adjacent untwisted portion of the arms 118 to effect their rotation relative to the major planar extent of the carrier strip. The carrier strip preferably is provided with pilot holes 120 which cooperate with alignment pins to facilitate indexing of the strip, for example, through one or more stations of fabricating apparatus.

Figure 21:
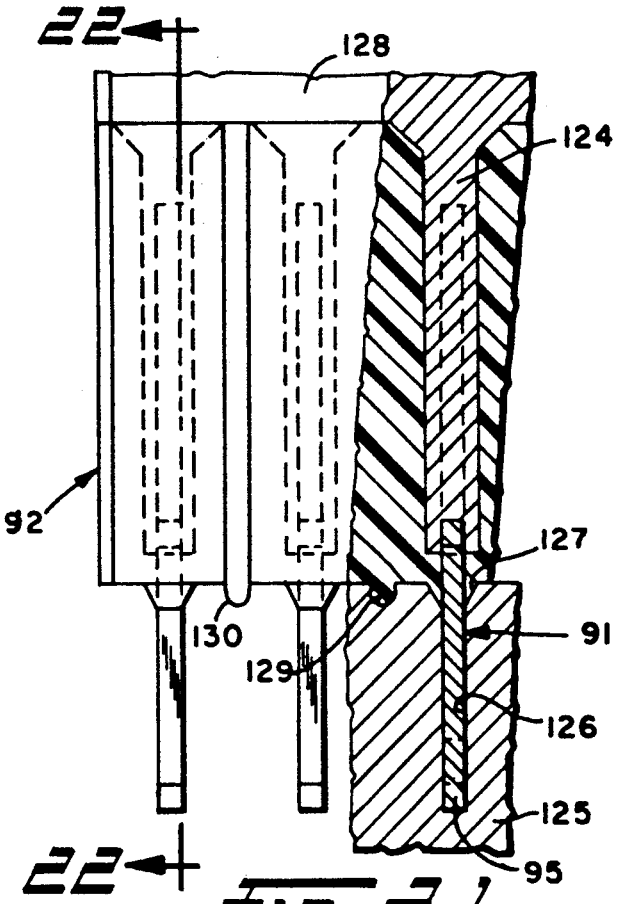
FIG. 21 is a partial view similar to FIG. 19 with the female header being shown before removal from a core member according to the invention.
Figure 22:
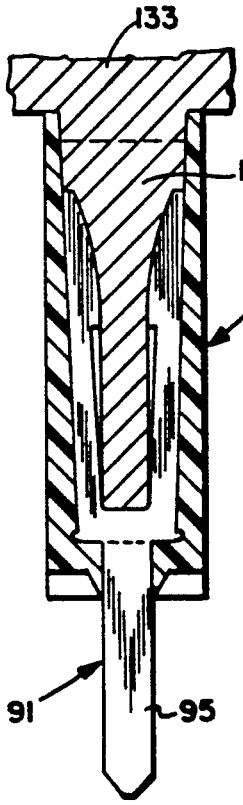
FIG. 22 is a partial sectional view of the female header and core member taken substantially along the line 22—22 of FIG. 21.
Figure 23:
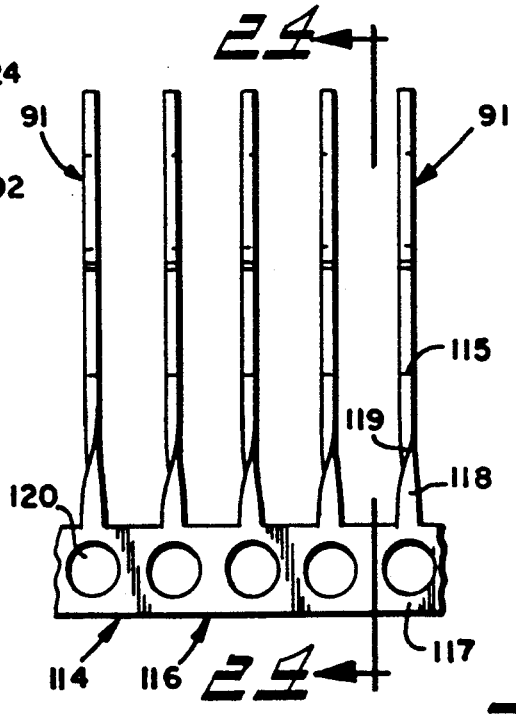
FIG. 23 is a partial plan view of a contact strip having use with the method of the invention in making the female header.
Figure 24:
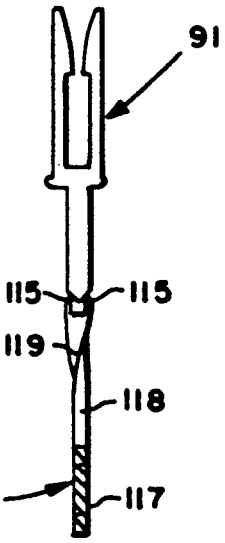
FIG. 24 is a sectional view of the contact strip taken substantially along the line 24—24 of FIG. 23.

Continuing with the method of making the female header 90, the contact strip 114 may be manipulated to place the contacts 91 thereof into engagement with respective mold cores of a mold. In FIGS. 21 and 22, the mold cores are indicated at 124 and the contacts are shown in proper placement with respect to the mold cores 124, even though the body 92 is shown as molded with respect to the contacts. After such placement, the method of making the female header 90 proceeds in a manner substantially similar to that aforedescribed with respect to the cable termination assembly 1, except for modifications dictated by the several differences between the female header 90 and the cable termination assembly 1. For example, the lower mold part of a mold utilized to mold the female header would not be configured to accommodate the cable but instead to receive the male contacting portions of the contacts. As illustrated in FIG. 21, the lower mold part 125 may include plural holes 126 each sized to receive and provide a close off with respect to the male contacting portion 95 of the respective contact 91. The cavity end of the hole 126 preferably has a tapered entranceway as seen at 127 to facilitate guiding of the male contacting portion into the hole as the lower mold part 125 and upper mold part 128 are moved relatively towards one another to close the mold. The lower mold part may also include one or more recesses 129 in the cavity surface thereof for the purpose of forming stand-offs 130 on the bottom surface of the header body.

Since the chamber 109 containing the female contacting portion 94 of each contact 91 of the female header 90 is essentially identical to the corresponding chamber 26 in the above described cable termination assembly 1, the mold cores 124 are likewise essentially identical and depend in generally parallel relationship from a base 133 which may be mounted with respect to the upper mold part 128 for movement therewith during opening and closing of the mold. For details respecting the cores 124, reference may be had to the above described mold cores 45.

Figure 25:
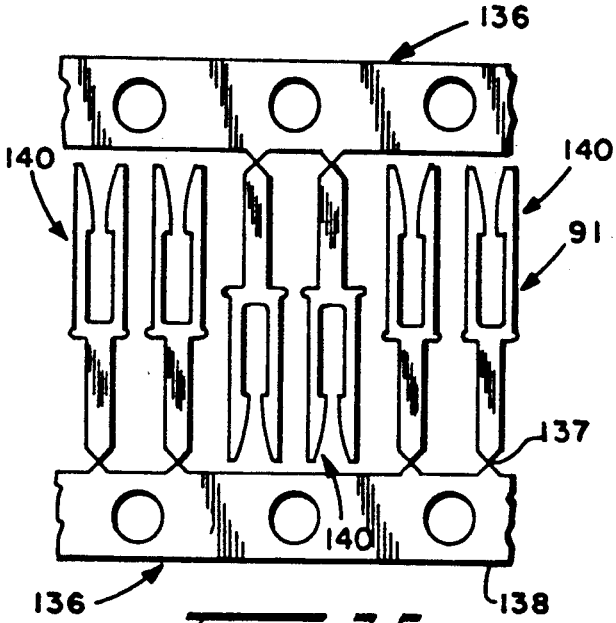
FIG. 25 is a partial plan view of two contact strips of another form, the strips being shown as the same are stamped from a thin sheet of metal in a pattern relationship optimizing usage of material stock.
Figure 27:
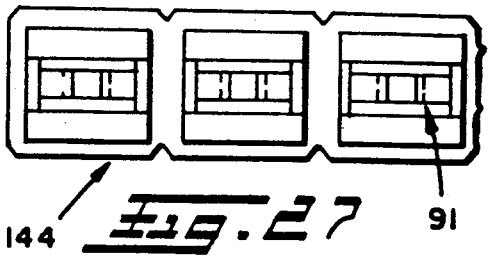
FIG. 27 is a partial top plan view of the female header of FIG. 26 looking generally in the direction of the arrows 27—27 of FIG. 26.

In FIG. 25 a different form of contact strip usable with the method of the invention is indicated generally at 136. Actually portions of two such strips 136 are shown as the same may be die cut or stamped from a single sheet of conductive metal material. Such stamping of two contact strips 136 from a single sheet in the illustrated pattern relationship optimizes the use of material stock. The contacts 91 of each contact strip 136 are attached by thin connections 137 to a respective carrier strip 138 which facilitates manipulation of the contacts as during placement into engagement with mold cores of a mold to form composite mold cores having the above described attributes.

The illustrated contact strips 136 are particularly useful in making a female header of the type shown in FIGS. 18–20 but having two rows of contacts instead of one row as shown. In FIG. 20, the two strips 136 can be seen to be reversely oriented with each strip having respective sets 140 of relatively adjacent contacts alternating with the contact sets of the other strip along their coextending lengths. The contacts 91 of each set 140 may be simultaneously placed into engagement with respective transversely aligned mold cores of a mold for a dual row female header. That is, the plane of the contact set may be oriented at right angles to each one of the two rows of mold cores needed to form the dual row female header in a manner generally similar to that above described. Of course, the contacts of additional contact sets would be similarly placed into engagement with respective transversely aligned mold cores, the number of placed contact sets being equal the number of contacts in each row of the female header. As a result of this alignment relation to the rows of mold cores, the above described rotating of contacts out of the plane of the strip material from which they are formed is eliminated.

In general, contact strips of the type shown in FIG. 25 may be used to make headers of the type shown in FIGS. 18–20 which have any number, or n rows of contacts. For this, the contact strips are formed with contact sets 140 each including n contacts. In multiple row headers, the contacts in each set would of course be positioned at the same center-to-center spacing as that of the rows of contacts in the female header to permit easy placement of the contacts into proper engagement with correspondingly positioned mold cores thereby to form respective composite mold cores which function as aforedescribed.

The contact strips 136 also may be used to facilitate placement of contacts into engagement with mold cores associated with multiple mold cavities into which plural female headers are molded simultaneously. In this application the spacing between the contact sets is equal the spacing between the cavities of the mold whereby the carrier strip 138 may be manipulated simultaneously to place the contacts of plural sets into engagement with mold cores associated with respective different mold cavities in which the header bodies of plural headers are to be simultaneously molded. Of course, the carrier strip may then be removed as by bending and breaking at the thin connections 137 to permit closing of the mold, including the mold cavities.

In FIGS. 26–29, another type of female header made in accordance with the invention is indicated generally at 144. The female header 144 is for the most part identical to the above described female header 90 of FIGS. 18–20 except that the planar contacts 91 are rotated 90° . The header 144, as shown, includes only one row of contacts wherein the planes of the contacts reside in a common plane. It should be understood, however, that the female header may include just one contact or plural contacts arranged in more than one row as illustrated by phantom lines in FIG. 28.

Figure 29:
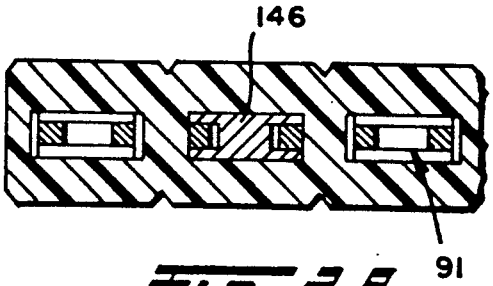
FIG. 29 is a partial sectional view of the female header of FIG. 26 (and the core element illustrated therewith) taken substantially along the line 29—29 of FIG. 26.
Figure 26:
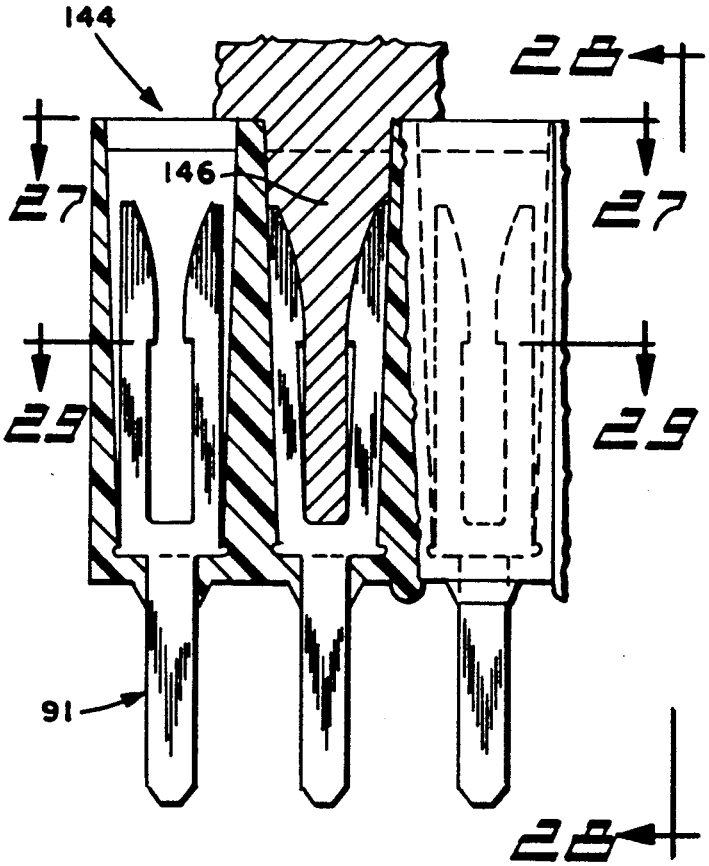
FIG. 26 is a partial view, part in elevation and part in section, of another type of female header according to the invention, there being illustrated a core element in relation to one contact and cell of the female header.
Figure 28:
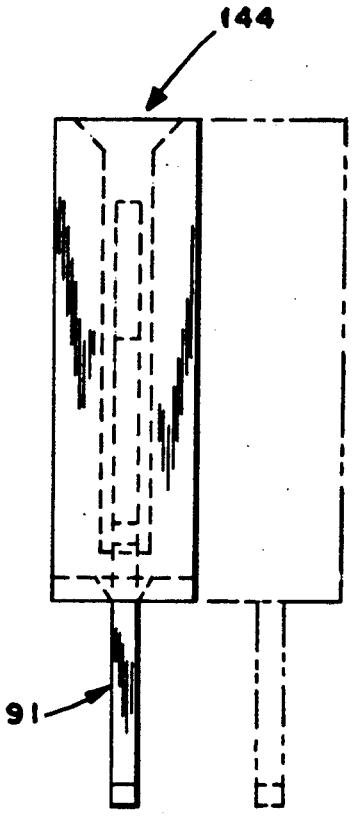
FIG. 28 is an end elevational view of the female header of FIG. 26 looking generally in the direction of the arrows 28—28 of FIG. 26.
Figure 30:
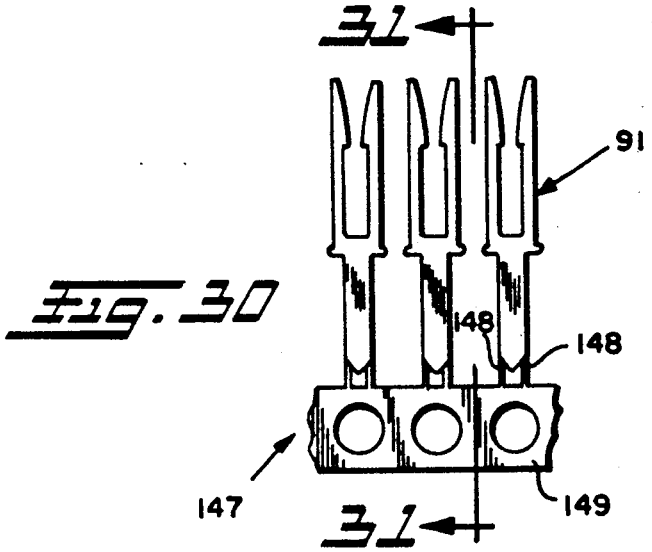
FIG. 30 is a partial plan view of a contact strip having use in making the female header of FIG. 26 according to the method of the invention.
Figure 31:
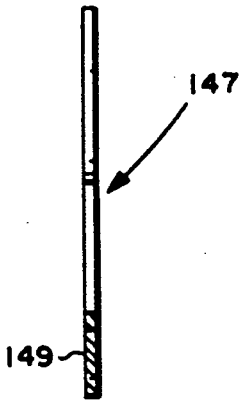
FIG. 31 is a sectional view of the contact strip of FIG. 30 taken substantially along the line 31—31 of FIG. 30.

The female header 144 may be made in substantially the same manner as that described above with respect to the female header 90 of FIGS. 18–20 except for modifications necessitated by the different orientation of the contacts 91. Accordingly, each contact 91 is placed into engagement with a respective mold core, the middle contact of FIGS. 26 and 29 being shown in such placed engagement with a respective mold core 146 while the outermost two contacts in FIGS. 26 and 29 are shown in their unflexed condition following removal of respective mold cores (not shown). In FIGS. 30 and 31 there is illustrated at 147 contact strip which may be used to facilitate simultaneous placement of the contacts into engagement with respective mold cores substantially as aforedescribed. Each contact is attached by a pair of thin connections 148 to a carrier strip 149 which maintains the contacts coplanar and uniformly spaced apart at the same center-to-center spacing of the contacts in the header being made. As before, the contact strip may be formed by stamping or die cutting a thin sheet of conductive metal material.

Figure 34:
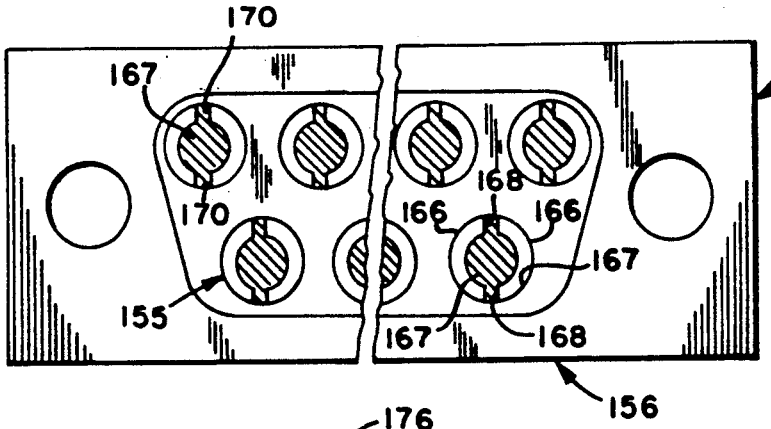
FIG. 34 is a plan/sectional view of the D-connector/-core member of FIG. 33 taken substantially along the line 34—34 of FIG. 33.
Figure 33:
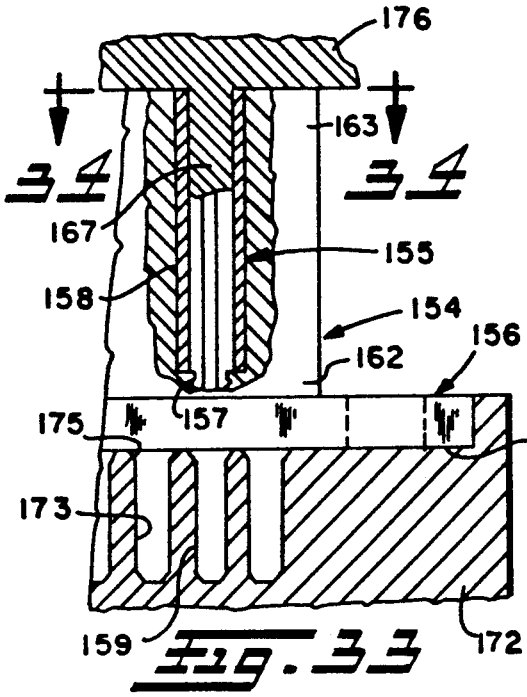
FIG. 33 is a view similar to FIG. 32 with the D-connector being shown before removal from a core member according to the present invention.
Figure 32:
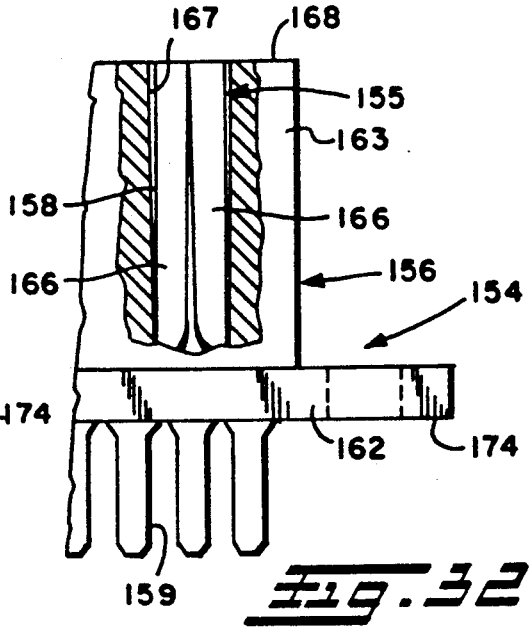
FIG. 32 is a partial elevational view, partly broken away in section, of a D-connector made in accordance with the invention.

With reference to FIGS. 32–34, it will be seen that principles of the invention may be applied to form yet another type of electrical connection device including other types of electrical contacts. In FIGS. 32–34, a D-connector made in accordance with the invention is indicated generally at 154. The D-connector includes plural electrical contacts 155 held in relative position by a molded body or housing 156. The connector body preferably is molded directly to and about an intermediate base portion 157 of each contact from which extend in opposite directions a female contacting portion 158 and a male contacting portion 159. In the illustrated embodiment, the male contacting portion 159 is in the form of a flat pin contact and the female contacting portion is in the form of what may be called a tulip fork contact.

The connector body 156 has a lower or base portion 162 which is molded directly to the intermediate portions 157 of the contacts 155 as above indicated and which holds the contacts in relative position. The connector body also has an upper or cover portion 163 which functions to contain and protect the female contacting portions 158, maintain electrical isolation of the female contacting portions and guide mating male contacts such as round or circular pin contacts of an external device to proper engagement with the female contacting portions.

The female contacting portion 158 of each contact 155 includes a pair of resiliently deflectable elongate arms 166 extending in generally parallel relation from the intermediate portion 157 of the contact which is at least partly molded in the connector body. The contacting arms 166, which have an arcuate cross-sectional shape, are contained in a respective chamber or cell 167 opening to the leading end 168 of the connector body 156. Each chamber 167 preferably is cylindrical with the radius of the circular cross-section thereof preferably corresponding to the radius of the arcuate contacting arms 166.

In FIG. 32, the contacting arms 166 are shown in their normal undeflected condition. Going from bottom to top, the contacting arms slope slightly towards one another and form at their back sides with the wall of the cell respective spaces or gaps into which the contacting arms can deflect to receive therebetween a pin contact. In FIGS. 33 and 34, the contacting arms are shown as the same preferably would be outwardly deflected away from one another upon insertion of a pin contact therebetween, although the contacting arms are shown in relation to mold cores 167 of a mold employed to mold the connector body 156. As is preferred, the contacting arms and the mating pin contacts intended for use therewith are relatively configured such that upon insertion of the pin contacts between the contacting arms, the contacting arms are deflected outwardly away from one another to a condition having their outer surfaces just or about contiguous with the wall of the cell for reasons like those discussed above with respect to planar fork contacts. As seen in FIG. 34, the contacting arms define elongate gaps or spaces 168 between opposed, then generally parallel edges thereof.

The D-connector 154 is made in a manner substantially similar to that aforedescribed. Prior to molding of the connector body 156, the contacts 135 are placed into engagement with respective mold cores 167 of a mold. As seen in FIGS. 33 and 34, each mold core 167 is generally circular in cross-section except for two diametrically opposed spacer ribs 170 which extend along the length of the mold core coextensively with the female contacting portion of the contact. When the contact is axially inserted onto the mold core, the spacer ribs 170 pass between the opposed edges of the contacting arms 166 to urge the same apart and to fill the gap thusly formed therebetween to prevent passage of molding material between the contact edges. Also, the generally circular center portion of the mold core, along with the spacer ribs, cause the contacting arms to deflect outwardly and preferably to the normal condition of the contacting arms during use in connection with a correspondingly sized contact pin inserted therebetween. As a result, the mold core cooperates with the contacting arms to form a composite mold core in part formed by the mold core and in part by a part of the contact including the deflectable contacting arms. As will be appreciated, particularly when comparing FIG. 32 with FIG. 33, the composite core defines the space within which the contacting arms can deflect resiliently during insertion and withdrawal of a pin contact therebetween.

As illustrated in FIG. 33, a lower mold part 172 may include plural holes 173 each sized to receive and provide a close off with respect to the male contacting portion 159 of a respective contact which, in the illustrated embodiment, extend from the bottom surface 174 of the connector body 156 in generally parallel relation with respect to one another. The cavity end of the hole preferably has a tapered entranceway 175 to facilitate guiding of the male contacting portion into the hole as the lower mold part and an upper mold part 176 are moved relatively towards one another to close the mold.

Figure 35:
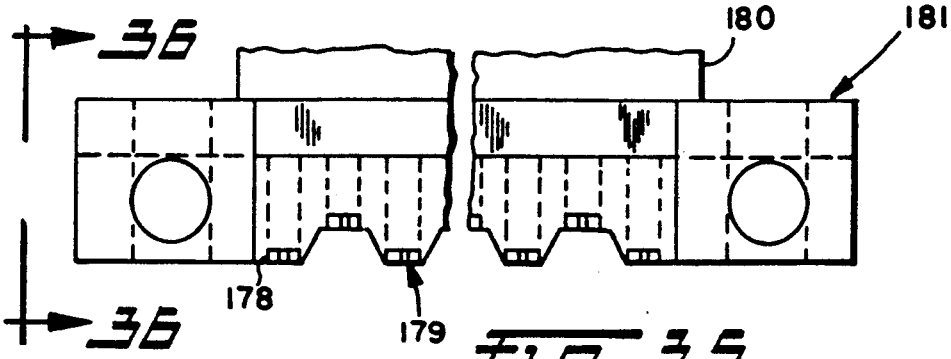
FIG. 35 is a partial elevational view showing a modified pin-out configuration for the D-connector of FIG. 32.
Figure 36:
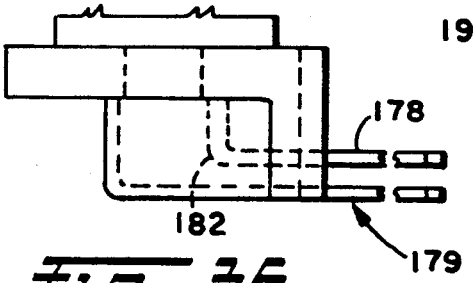
FIG. 36 is a partial end elevational view of the modified D connector of FIG. 35 looking in the direction of the arrows 36—36 of FIG. 35.
Figure 37:
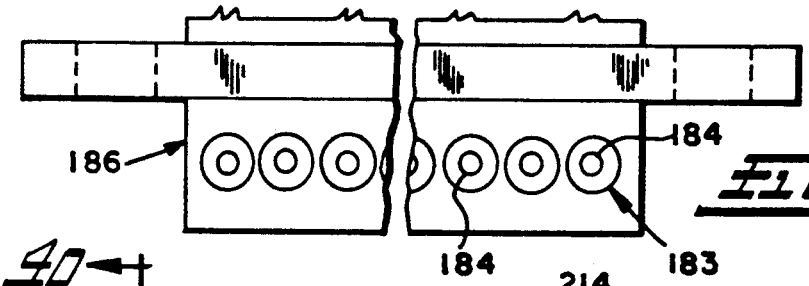
FIG. 37 is a partial/fragmentary elevational view showing the D connector of FIG. 32 employed as the termination of a cable including plural separately insulated conductors.

As will be appreciated, the D-connector may employ other forms of terminating means than the planar flat pin contacts 159 illustrated in FIGS. 32–34. In FIG. 35, it can be seen that male contacting portions 178 of contacts 179 may extend in a direction generally perpendicular to the direction of female contacting parts in the upper cover portion 180 of the body 181. This may be accomplished by providing the intermediate portion 182 of the contacts 179, about which the connector body 182 is molded, with a right angle bend. Moreover, the male contacting portions 178 of alternating contacts may be vertically offset from relatively adjacent contacts to provide the staggered arrangement illustrated in FIGS. 35 and 36. As seen in FIG. 37, the D-connector alternatively may be directly connected to a flat ribbon cable or, as illustrated, to a cable or conductor set 183 consisting of discretely insulated conductors 184. To effect such direct connection, the contacts may have IDC terminal ends for mechanical and electrical connection to the conductors 184 in the cable set, such electrical connection being effected and the connector body 186 being molded about the cable substantially as aforedescribed in connection with the cable termination assembly 1.

Figure 38:
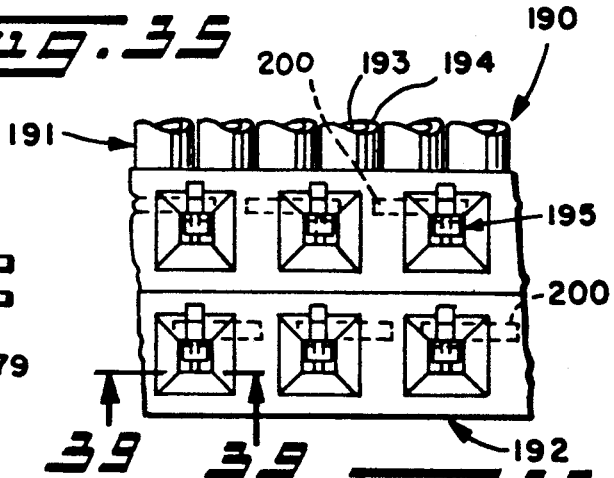
FIG. 38 is a partial top plan view of a another cable termination assembly according to the invention.
Figure 39:
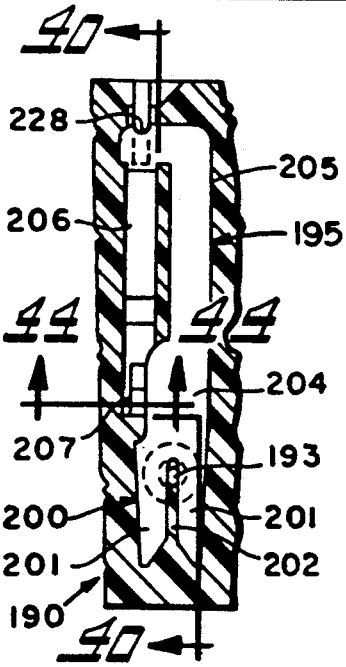
FIG. 39 is a partial sectional view of the cable termination assembly of FIG. 38 taken substantially along the line 39—39 of FIG. 38.
Figure 40:
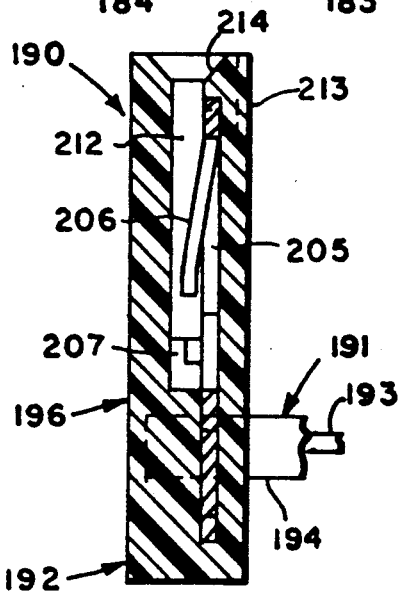
FIG. 40 is a sectional view of the cable termination assembly of FIG. 38 taken substanally along the line 40—40 of FIG. 39.

Turning now to FIGS. 38–40, a cable termination assembly employing another type of contact is illustrated generally at 190. The cable termination assembly 190 includes an electrical cable 191 and a cable termination 192. The cable 191 includes one or more electrical conductors 193 within individual or common cable insulation 194. The cable termination 192 includes one or more electrical contacts 195 electrically connected to respective cable conductor(s) and held in relative position by a strain relief body or housing 196 of electrically non-conductive material.

The contacts 195 are electrically connected at terminal portions 200 thereof to respective conductors 193 of the cable 191. The terminal portion 200 of each contact and the connection to the cable conductor is substantially the same as that above described with respect to the cable termination assembly 1. Accordingly, the terminal portion includes a pair of prong-like arms 201 defining therebetween a relatively narrow slot 202 for receiving the respective conductor of the cable.

Figure 44:
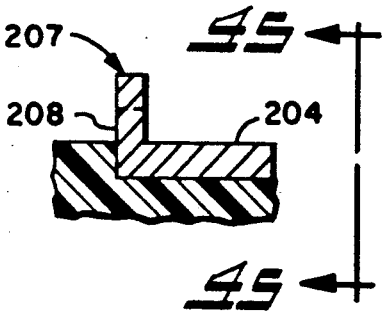
FIG. 44 is a partial sectional view of a contact hook taken substantially along the line 44—44 of FIG. 39.
Figure 45:
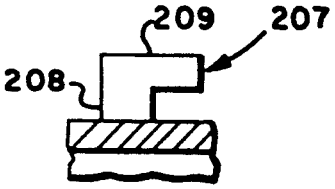
FIG. 45 is an elevational view of the contact hook looking generally in the direction of the arrows 45—45 of FIG. 44.

In addition to the terminal portion 200, each contact 195 includes a base portion 204, a J-shape arm portion 205 extending from the base portion in a direction opposite the terminal portion, and a wiping arm 206 extending from the short leg of the arm portion generally parallel to and laterally offset from the long leg or stem part of the arm portion. Each contact also includes for reasons hereinafter discussed an L-shape hook 207 joined at one edge to the base portion 204 with one leg 208 of the L-shape hook extending perpendicular to the plane of the base portion and the other leg 209 extending parallel to the base portion but spaced out of the plane of the base portion as seen in FIGS. 44 and 45. Thus, there is in effect formed a hook with the bite of the hook opening upwardly towards and generally in line with the wiping arm 206. The wiping arm, as best seen in FIG. 40, slopes out of the major planar extent of the contact in the same direction as the L-shape hook 207 projects out of the plane of the contact.

As seen in FIG. 38, the contacts 195 of the cable termination are arranged in a dual-in-line pattern. As is desirable, the terminal portions 200 of the contacts in one row are offset with respect to the wiping arm 206 thereof in a direction opposite the offset of the terminal portions of contacts in the other row. This offset configuration of the electrical contacts allows them to be a reasonable size with the wiping arm of each contact in one row being directly aligned with the wiping arm of an opposite contact in the other row and with each of the relatively closely positioned parallel cable conductors being connected to only a single respective contact.

The wiping arm 206 of each contact 195 is resiliently deformable from its position illustrated in FIG. 40 to another condition generally coplanar with the other major portions of the contact as by placement of a male type member, such as a pin contact, to engagement therewith during use of the contact. The wiping arm is contained in a respective chamber or cell 212 formed in the strain relief body 196 and, more particularly, in a cover portion 213 of such body. Each cell 212 has a tapered entranceway 214 for guiding the respective pin contact or the like into the cell and to engagement with the wiping arm. As a pin contact is inserted into the cell, it will engage and cause the wiping arm resiliently to deflect towards and into the plane of the arm portion 205 disposed in the illustrated embodiment flush with one side of the cell. The resiliency of the wiping arm will cause the wiping arm to be held in forced mechanical and electrical engagement with the adjacent side of the pin contact which, for example, may be a conventional square pin contact.

Figure 41:
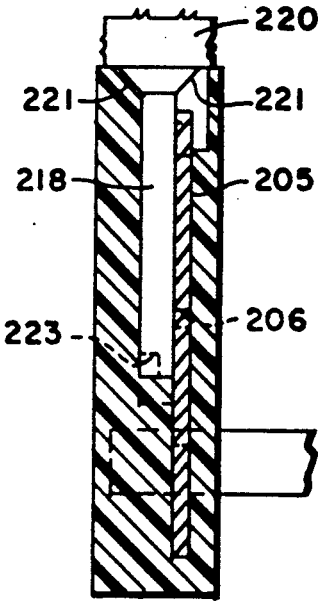
FIG. 41 is a view similar to FIG. 40 with the cable termination being shown before removal from a core member according to the invention.
Figure 42:
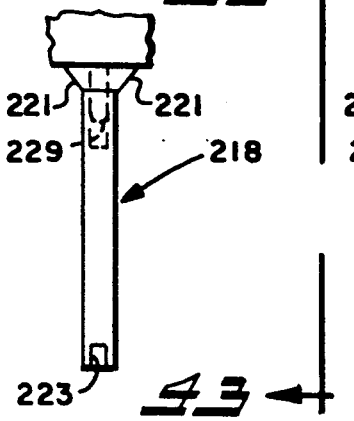
FIG. 42 is an elevational view of a core element of the core member of FIG. 41.
Figure 43:
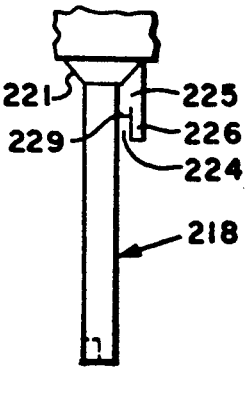
FIG. 43 is an elevational view of the core element of FIG. 42 looking generally in the direction of the arrows 43—43 of FIG. 42.

A preferred method of making the cable termination assembly 190 is similar to the aforedescribed procedures with modification being made to accommodate the different contact structure illustrated in FIGS. 38–40. As seen in FIGS. 41–43, a mold core used to form a composite mold core with a respective contact 195 is indicated generally at 218. As before, there is one mold core 218 for each contact and cell 212 associated therewith that respectively are to be molded into and formed in the strain relief body 196 of the cable termination assembly. The mold cores depend from an upper mold part 220 with the relative positions or arrangement of the mold cores corresponding to the intended arrangement of cells in the strain relief body to be molded. As will normally be the case, the mold cores are generally parallel and essentially identical to one another.

As seen in FIGS. 42 and 43, each mold core 218 is generally elongate and is joined at its upper end to the upper mold part 220 or base of a core bar. The illustrated mold core is generally rectangular and, more particularly, square in cross-sectional shape, and the elongate side surfaces thereof terminate at their upper ends at outwardly sloped chamfer forming surfaces 221 which, as will be appreciated, operate to define the tapered entranceway 214 to the respective cell 212 in the strain relief body.

With reference to FIGS. 42 and 43 and also to FIG. 41 where the contact 195 is shown in engagement with the mold core 218 to form a composite core, the wiping arm 206 is caused by an adjacent side surface of the mold core to be flexed towards and into the plane of the arm 205. To hold the contact in place on the mold core, the upwardly extending leg of the contact hook 207 is received in a notch 223 formed at the bottom of the mold core. Also, the upper end of the contact, more particularly the base of the J-shaped arm 205 in line with the wiping arm, is captured in a slot 224 formed between the side surface of the mold core which is contacted by the wiping arm and a retention hook 225 provided at the upper end of the mold core. The retention hook 225 preferably is an integral part of the mold core and projects from the side of the mold core contacted by the wiping arm to form at a depending leg 226 the retention slot 224 for receiving and retaining the upper end of the contact in proper position with respect to the mold core. The base of the J-shape arm 205 of the contact preferably is provided with a notch as seen at 228 in FIG. 39 which cooperates with a correspondingly curved surface 229 (FIGS. 42 and 43) of the retention hook 225 at the upper end of the downwardly opening retention slot 224 to hold the contact in proper alignment with the mold core, i.e., to prevent the contact from going cockeyed or askew to the mold core. Although the notch in the contact and the corresponding surface of the retention hook may be arcuate as illustrated, it will be appreciated that the notch and corresponding surface may be otherwise configured, for example, with a V-shape.

After the contacts 195 have been placed into engagement with the mold cores 218 to form respective composite mold cores, the method of making the cable termination assembly 190 may proceed in a manner substantially similar to that aforedescribed with respect to the cable termination assembly 1. That is, during closure of the mold, the contacts supported by the mold cores may be caused at the terminal portions 200 to pierce through the insulation 194 surrounding the cable conductors 193 to effect IDC joinder of the terminal portions of the contacts with the conductors of the cable. After the mold is closed, molten plastic material then may be introduced into the cavity of the mold as by injection to form the strain relief body 196. During such molding, the cells 212 in the strain relief body will be formed by the composite core molds which are formed in part by the mold cores and in part by the wiping arms of the contacts. After such molding and opening of the mold, the thusly formed cable termination assembly may be removed from the mold, and as the assembly is withdrawn from the mold cores, the wiping arms will flex back to their normal unflexed condition. As this occurs, there will be provided behind each wiping arm an open space into which the wiping arm may deform when a male contact is inserted into the cell and into engagement with the wiping arm of the contact.

It is noted that the strain relief body will be molded about the stem of the J-shape arm portion 205 of each contact 195 thereby further securely to lock the contact in the strain relief body.

Figure 46:
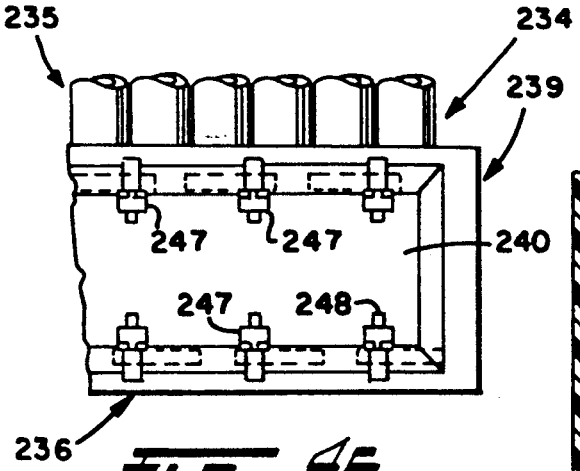
FIG. 46 is a partial top plan view of a cable termination assembly of edge board connector type.
Figure 47:
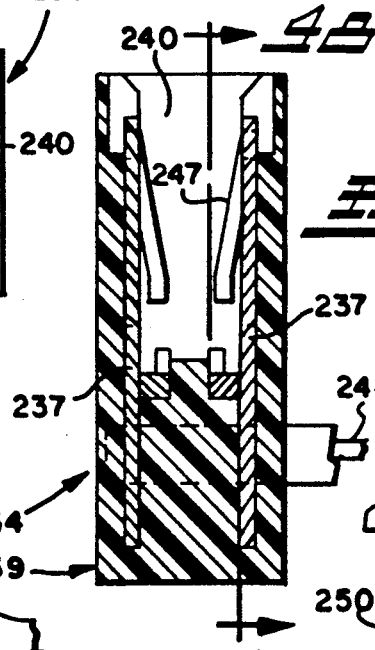
FIG. 47 is a partial sectional view of the cable termination assembly of FIG. 46.
Figure 48:
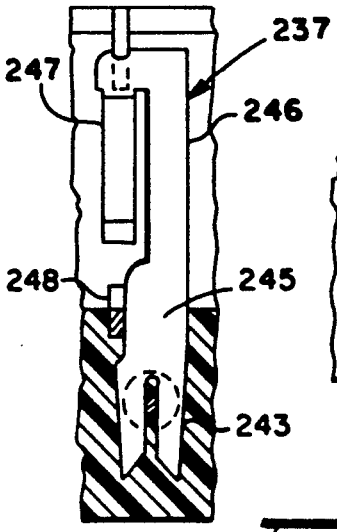
FIG. 48 is a partial sectional view of the cable termination assembly of FIG. 46 taken substantially along the line 48—48 of FIG. 47.

Turning now to FIGS. 46–48, there is generally indicated at 234 another type of cable termination assembly intended to connect with terminal pads proximate the edge of a printed circuit board. The cable termination assembly 234 includes a multiconductor cable 235 and a cable termination 236 in the form of an edge board connector. The edge board connector 236 includes one or more electrical contacts 237 electrically connected to respective cable conductors 238 and held in relative position by a strain relief body or housing 239. The strain relief body 239 is molded directly to and about at least a part of the cable and contacts to form therewith a unified structure. The contacts 237 are positioned in the strain relief body along opposed sides of a board slot 240 formed in the strain relief body for receiving the edge of a circuit board, card or the like on which a plurality of terminal pads or other conductive paths are located proximate the edge of the board for electrical connection with respective contacts. Although two rows of contacts are shown, the edge board connector may use ono or two rows of contacts each including one or more contacts which may be arranged in paired opposition to contacts in the other row. Moreover, the connector body may include more than one board slot with contacts arranged therein for coupling of plural circuit boards or the like with the edge board connector at respective slots.

In the illustrated exemplary edge board connector 236, the contacts 237 are identical to the contacts 195 described above in connection with the cable termination assembly 190 of FIGS. 38–40. Accordingly, the contacts have terminal portions 243 for forming IDC junctions with respective conductors 244 of the cable 235. Each contact also includes a base portion 245, a J-shape arm portion 246, a wiping arm portion 247 and a hook 248.

Figure 50:
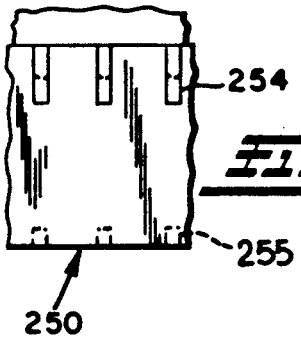
FIG. 50 is a partial elevational view of the core member of FIG. 49.
Figure 49:
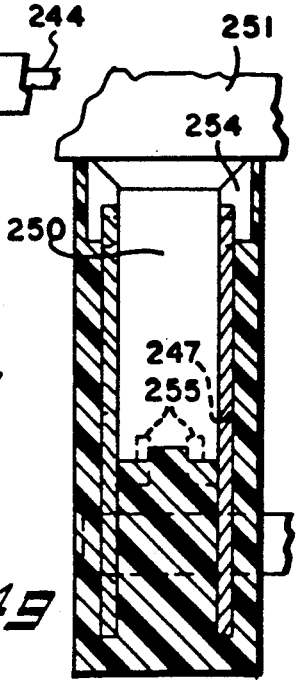
FIG. 49 is a view similar to FIG. 47 with the cable termination being shown before removal from a core member according to the present invention.

Respecting manufacture of the cable termination assembly, FIGS. 49 and 50 show a preferred form of mold core at 250. Preferably the mold core is a unitary body having plural regions to which respective contacts 237 may be placed into engagement therewith at opposite sides thereof as best seen in FIG. 49. The mold core may be included in or attached to the upper mold part 251.

The mold core 250 has along the top edge thereof a plurality of retention hooks 254. The retention hooks 254 are substantially the same as the above described retention hooks 225. Along the bottom of the mold core, there is provided a plurality of notches 255 for receiving the contact hooks 248 of respective contacts placed into engagement with the side surfaces of the mold core. The retention hooks and notches are arranged in pairs and each pair thereof functions to hold a respective contact to and in proper position with respect to the mold core. When each contact is placed into engagement with the mold core, the hook thereof will be locatingly received in the respective notch and the upper end of the contact will be captured in the bight of the retention hook. Also, the wiping arm 247 will engage the side surface of the mold core and be caused thereby to flex into the plane of the contact arm as seen in FIG. 49 from its unflexed condition best seen in FIG. 48.

After placement of the contacts 237 on the mold core 250 there is formed a composite mold core which defines the slot 240 to be formed in the edge board connector body 239, the latter being injection molded into the mold after the mold has been closed. During closing of the mold, the contacts supported by the mold core may be caused at the terminal portions 243 thereof to pierce through the insulation surrounding the conductors 244 to effect IDC joinder of the terminal portions of the contacts with the conductors of the cable. After the mold is closed molten plastic material then may be introduced into the cavity of the mold as by injection to form the strain relief body. During such molding the card socket or slot 240 will be formed by the composite core mold consisting of the core mold and the contacts placed into engagement therewith. After such molding and opening of the mold, the thusly formed cable termination assembly may be removed from the mold and as the assembly is removed from the mold core the wiping arms of the contacts will flex back to their normal unflexed condition. As this occurs there will be provided behind each wiping arm an open space into which the wiping arm may deform when the edge of a circuit board or the like is inserted into the slot with contact pads thereon electrically connecting with respective wiping arms.

As will be appreciated, features of the cable terminations 192 and 236 may be employed in socket or card edge connectors of other types such as a board mount socket or edge board connectors. In general, one or more features of any herein disclosed embodiment of an electrical connecting device or method may be combined as desired with one or more features of other embodiments as may be desired for particular applications.

Although the invention has been shown and described with respect to certain preferred embodiments, the present invention includes all equivalents and is limited only by the scope of the following claims.

What is claimed is:

1. An electrical connecting device, comprising an electrical contact and housing means for containing at least part of said contact, said housing means having opening means for receiving therein one member for contacting said contact, said contact including a base and extending from said base at least two separate resilient contacting means for contacting at inner surfaces thereof said one member inserted between said contacting means, both said contacting means being capable of outward deformation to undergo substantially independent movement during inserting of said one member therebetween, said housing means including a body molded while said contacting means are outwardly deformed to form an integral structure about and to at least part of said contact and around at least part of said two contacting means to form said opening means in said housing means between said two contacting means and open spaces formed by said contacting means when outwardly deformed and defined by spaces created when said contacting means resiliently return inwardly to an undeformed position, said open spaces being adjacent respective ones of said two contacting means to permit such outward deformation of both said contacting means for insertion of the one member between said two contacting means.

2. The device of claim 1, wherein said body is in the form of a header body.

3. The device of claim 1, said contacting means including fork contacts.

4. The device of claim 1, wherein each of said contacting means has an arcuate cross-section and wherein said contacting means are oriented to form a tulip shape contact.

5. An electrical device including a plurality of electrical connecting devices as set forth in claim 1, said contacts of said electrical connecting devices arranged in a line.

6. An electrical device including a plurality of electrical connecting devices as set forth in claim 1, said contacts of said electrical connecting devices arranged in a dual-in-line pattern.

7. The device of claim 1, wherein said contact includes a terminal portion extending from said base in a direction generally opposite said contacting means.

8. The device of claim 7, wherein said terminal portion is in the form of a planar contact.

9. The device of claim 7, wherein at least a part of said terminal portion extends through said molded body.

10. The device of claim 7, further comprising conductor means for electrical conduction, and wherein said terminal portion includes engagement means for electrically engaging said conductor means.

11. The device of claim 10, wherein said conductor means includes an insulated cable, and wherein said engagement means includes prong-like arms for penetrating the insulation of said cable for electrical connection between said cable and said engagement means.

12. The device of claim 10, wherein said molded body forms an integral structure about at least part of the junction of said engagement means and said conductor means.

13. An electrical connecting device, comprising an electrical contact and housing means for containing at least part of said contact, said housing means having opening means for receiving therein one member for contacting said contact, said contact including a base and a resilient wiping arm extending generally parallel to and laterally offset from said base so as to protrude into said opening means, said wiping arm capable of deforming substantially into a generally open area of said opening means to electrically contact said one member when inserted in said opening means, said housing means including a body molded to form an integral structure about and to at least part of said contact and to form said opening means, said housing means having been molded while said wiping arm is in a deformed position to at least partly form said generally open area, said open area being defined by a space created when said wiping arm resiliently returns to an undeformed position.

14. The device of claim 13, wherein said contact includes a terminal portion extending from said base in a direction generally opposite said wiping arm.

15. The device of claim 14, further including electrical conduction means electrically connected to said terminal portion, and wherein said molded body forms an integral structure about at least part of the junction of said terminal portion and said conductor means.

16. An electrical device including a plurality of electrically conductive members supported in a molded body of electrically non-conductive material, the molded body having therein a respective space for each conductive member, in which space at least part of the conductive member is movable for electrically connecting with an external member inserted into said space, said movable part comprising plural separate contacting means for mechanically engaging and electrically connecting with such external member, said plural contacting means being supported from a common base and being separately movable relative to each other and to said base, said electrical device being made according to the method comprising the steps of placing the conductive members in a mold, molding the body using the mold, and removing the molded body from the mold with the conductive members supported therein, said placing step including placing the separate contacting means of each conductive member into engagement with a mold core such that the movable part of the conductive member cooperates with the mold core to form a composite mold core defining the space in the body, and said molding step including molding the body to and about the composite mold core with at least a part of the body being molded into engagement with the movable part of the conductive member to form a wall of the space in the body, and wherein during placing of the conductive member the conductive member is resiliently deformed at a resiliently deformable portion thereof to deflect the movable part of the conductive member to a condition different than its normal undeflected condition, and wherein after molding the body the movable part of the conductive member is permitted to move inwardly towards its normal undeflected condition upon removal of the mold core to provide an open region outwardly adjacent the movable part and into which the movable part moves upon insertion of the external member into said space to engagement with an inner surface of said movable part.

* * * * *